US006905346B2

(12) United States Patent
Momota et al.

(10) Patent No.: US 6,905,346 B2
(45) Date of Patent: Jun. 14, 2005

(54) JUNCTION BOX, CONNECTOR, AND CONNECTING TERMINAL FOR USE IN THE BOX AND CONNECTOR

(75) Inventors: Atsushi Momota, Ohta (JP); Ichiro Terunuma, Yachiyo (JP); Hideyuki Kosugi, Matsudo (JP); Nobumasa Misaki, Tokyo (JP); Sukebumi Seo, Chiba (JP)

(73) Assignee: Fujikura Ltd., Tokyo (JP)

( * ) Notice: Subject to any disclaimer, the term of this patent is extended or adjusted under 35 U.S.C. 154(b) by 1 day.

(21) Appl. No.: 10/277,985

(22) Filed: Oct. 23, 2002

(65) Prior Publication Data

US 2003/0077927 A1 Apr. 24, 2003

(30) Foreign Application Priority Data

| | | |
|---|---|---|
| Oct. 24, 2001 | (JP) | 2001-326147 |
| Oct. 24, 2001 | (JP) | 2001-326148 |
| Oct. 24, 2001 | (JP) | 2001-326150 |
| Oct. 24, 2001 | (JP) | 2001-326151 |
| Oct. 24, 2001 | (JP) | 2001-326152 |
| Oct. 24, 2001 | (JP) | 2001-326157 |

(51) Int. Cl.[7] ..... H01R 9/09
(52) U.S. Cl. ..... 439/76.2; 439/884; 361/833
(58) Field of Search ..... 439/67, 76.2, 77, 439/492, 723, 874, 884, 949; 361/776, 823, 833

(56) References Cited

U.S. PATENT DOCUMENTS

| | | | | |
|---|---|---|---|---|
| 4,689,718 A | * | 8/1987 | Maue et al. | 361/686 |
| 4,767,357 A | * | 8/1988 | Hasircoglu | 439/499 |
| 5,004,426 A | * | 4/1991 | Barnett | 439/82 |
| 5,322,445 A | * | 6/1994 | Ozaki et al. | 439/212 |
| 5,934,933 A | * | 8/1999 | Kordecki et al. | 439/495 |
| 6,402,569 B1 | * | 6/2002 | Spadoni et al. | 439/723 |
| 6,547,572 B1 | * | 4/2003 | Burdick | 439/76.2 |
| 6,707,689 B2 | | 3/2004 | Momota et al. | |
| 6,736,648 B2 | | 5/2004 | Terunuma et al. | |

FOREIGN PATENT DOCUMENTS

| | | |
|---|---|---|
| JP | 10-243526 A | 9/1998 |
| JP | 2845082 B2 | 10/1998 |
| JP | 11-41753 A | 2/1999 |
| JP | 11-46426 A | 2/1999 |
| JP | 3236802 A | 9/2001 |

* cited by examiner

*Primary Examiner*—Thanh-Tam Le
(74) *Attorney, Agent, or Firm*—Sughrue Mion, PLLC

(57) ABSTRACT

There is disclosed a junction box including a junction box main body to which an electric component to be connected is attached, a connector portion, formed separately from the junction box main body, for connecting a connector of an outer wiring circuit, and a cable portion which includes a flexible printed circuit with a circuit portion including a conductor pattern formed on an insulating film, and electrically connects the junction box main body to the connector portion. With respect to an attachment position of one of the connector portion and junction box main body, an attachment position of the other can freely be changed.

31 Claims, 32 Drawing Sheets

JUNCTION BOX, CONNECTOR, AND CONNECTING TERMINAL FOR USE IN THE BOX AND CONNECTOR

CROSS-REFERENCE TO RELATED APPLICATIONS

This application is based upon and claims the benefit of priority from the prior Japanese Patent Applications No. 2001-326147, filed Oct. 24, 2001, No. 2001-326148, filed Oct. 24, 2001, No. 2001-326150, filed Oct. 24, 2001, No. 2001-326151, filed Oct. 24, 2001, No. 2001-326152, filed Oct. 24, 2001; and No. 2001-326157, filed Oct. 24, 2001, the entire contents of all of which are incorporated herein by reference.

BACKGROUND OF THE INVENTION

1. Field of the Invention

The present invention relates to a junction box and connector which include connecting terminals for electrically connecting a connector, fuse, and the like to a wiring circuit, and particularly to a junction box, connector, and connecting terminals for use in the junction box and connector which are lightweight and thin, have a high attachment freedom degree in freely changing connection positions with outer wiring circuits such as a harness, and can have waterproof/dustproof capabilities.

2. Description of the Related Art

In general, to branch a wiring of a car or the like, a junction box (J/B) has been used for purposes of space saving and cost reduction. FIG. 31 is a plan view of the junction box, FIG. 32 is a plan view of a bus bar contained in the junction box, FIG. 33 is a sectional view of a part VII of FIG. 31, and FIG. 34 is a sectional view of a part VIII of FIG. 31.

This type of a junction box 101 is constituted of a lower cover 102, a bus bar 103 attached to the lower cover 102, and an upper cover 105 which seals the lower cover and bus bar and to which a connector, fuse, and the like are attached. In the junction box 101, as shown in FIG. 32, the bus bar 103 formed, for example, of a pressed/punched metal plate of copper alloy, aluminum alloy, or the like is used to branch the wiring. Moreover, the junction box 101 also includes a function, for example, of a fuse box, when a fuse 107 is incorporated halfway in the wiring circuit constituted by the bus bar 103.

A connector 107 shown in FIG. 33 is a connector connected to the wiring circuit constituted of the bus bar 103. A connector 105*a* can be connected to the connector 107, when a connecting terminal portion 103*a* formed by bending a tip end of the bus bar 103 upwards by 90° is passed upwards through an upper cover 105 via a through hole 105*b* formed in the cover. Moreover, for a fuse attachment portion 105*c* to which a fuse 108 is attached as shown in FIG. 34, a connecting terminal portion 103*d* is formed by bending the tip end of the bus bar 103 with a slit 103*b* formed therein upwards by 90°, and is passed upwards through the upper cover 105 through a through hole 105*d* formed in the cover. Thereby, the connecting terminal portion can directly be connected to a leg 108*a* for connecting the fuse 108, or can be connected using a so-called female to female (F—F) terminal.

Moreover, as shown in FIG. 35, the bus bars 103 and insulation plates (IP) 109 having functions of supporting and insulating the bus bars 103 are alternately superimposed to form a wiring circuit (multilayered wiring circuit) 110 which has a multilayered structure. A junction box 112 structured to contain the multilayered wiring circuit 110 in a housing for entirely protecting the outside of the circuit as shown in FIG. 36 is frequently used.

However, in the above-described junction box 101, the bus bar 103 is manufactured by punching the metal plate with a die and the wiring circuit is formed. Therefore, when the bus bars 103 having various shapes are manufactured, different dies are required, and much cost is taken. Moreover, the bus bar 103 is formed of a thick metal, a weight of the junction box 101 therefore increases, and there is a problem that it is difficult to thin the junction box 101. Furthermore, in the junction box 112, the number of layers of the multilayered wiring circuit 110 needs to be minimized in order to prevent the weight and cost of the entire junction box from increasing. Additionally, the multilayered wiring circuit 110 having a small number of layers is used in accordance with a connection mode. For this, a circuit is drawn so as to avoid a wiring circuit of another layer and through holes 111 through which the connecting terminal portions 103*a*, 103*d* are passed, and a long circuit needs to be formed. This causes a problem that it is very difficult to lighten and thin the junction box 112. Furthermore, a portion to which the connector or the fuse is attached is integrally formed in the box. Therefore, each of these junction boxes 101, 112 has problems that a size is large to some degree and an attachment position of the box in the car is restricted. Moreover, the portion to which the connector or the fuse is attached has an integral structure. In this case, for example, the fuse attached portion is disposed in a front surface of an instrument panel of the car with the conventional junction box 101 or 112 disposed therein in consideration of enhancement of maintenance properties. This possibly conversely causes a problem that connection operation properties for connecting the connector of the outer wiring circuit are deteriorated. Furthermore, instead of using the connecting terminal portions 103*a*, 103*d*, connecting terminals are connected to the wiring circuit in order to attach the connector, fuse, and the like. In this case, it cannot be said that connection reliability is secure.

BRIEF SUMMARY OF THE INVENTION

An object of the present invention is to provide a junction box, connector, and connecting terminal for use in the box and connector in which weight saving and thinning are realized, freedom degree of layout is enhanced, and waterproof/dustproof capabilities can be achieved.

According to an aspect of the present invention, the above object is achieved by providing a junction box comprising: a junction box main body to which an electric component to be connected is attached; a connector portion which connects a connector of an outer wiring circuit, and is formed separately from the junction box main body; and a cable portion which is constituted of a flexible printed circuit with a circuit portion including a conductor pattern formed on an insulating film, and electrically connects the junction box main body to the connector portion, wherein the flexible printed circuit includes: a strip portion which connects the junction box main body to the connector portion; and a terminal connecting portion extending from a side edge of a position of the strip portion in which the junction box main body and connector portion are arranged in a short direction of the strip portion, the junction box main body includes: a junction box housing including a component attachment port to which the electric component to be connected is attached; and a plate-shaped connecting terminal on a junction box main body side, which is connected to the terminal connecting portion of the flexible printed circuit and contained in the junction box housing so as to be connected to the electric component to be connected, and the connector portion includes: a connector housing which is engaged with the connector of the outer wiring circuit; and a plate-shaped connecting terminal on a connector portion side, which is connected to the terminal connecting portion of the flexible printed circuit and contained in the connector housing so as to be connected to the connector of the outer wiring circuit.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Embodiments of the present invention will be described hereinafter with reference to the accompanying drawings.

Figure 1:
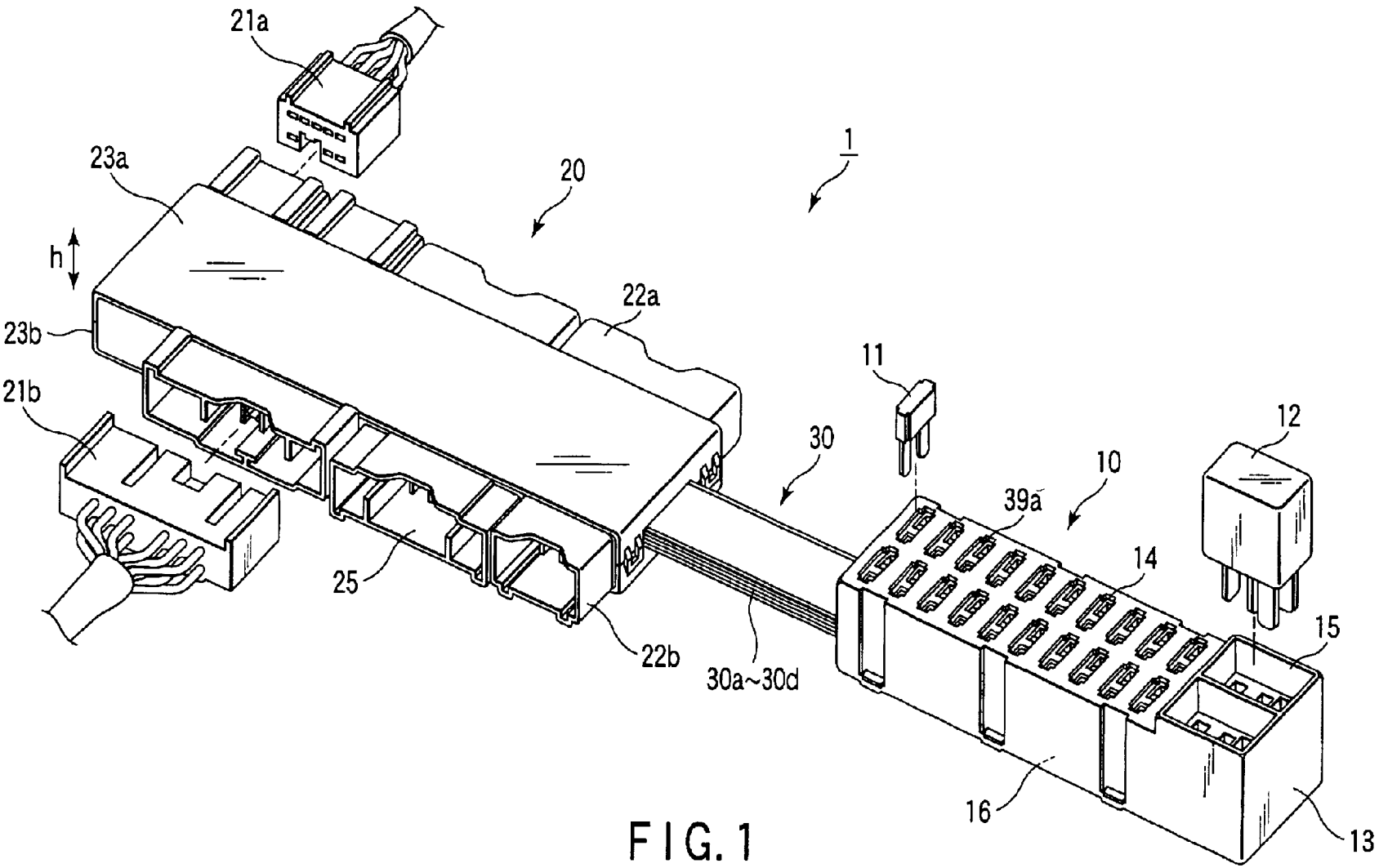
FIG. 1 is a perspective view showing an appearance of a junction box according to one embodiment of the present invention.

FIG. 1 is a perspective view showing an appearance of a junction box according to one embodiment of the present invention.

A junction box 1 is constituted of a junction box main body 10, connector portion 20, and cable portion 30 for connecting the junction box main body 10 to the connector portion 20. The cable portion 30 is formed by laminating a plurality of strip-shaped flexible printed circuits (hereinafter abbreviated as "FPC") 30*a* to 30*d* in a non-bonded state and bendable manner. The junction box main body 10 includes a junction box housing 13 formed of a resin molded member and a lid body 16 which is attachable/detachable with respect to the junction box housing 13, and is disposed on one end of the cable portion 30. In a surface (corresponding to a front surface) of the junction box housing 13 on the same side as main surfaces of FPCs 30*a* to 30*d*, a plurality of fuse attachment portions 14 and relay attachment portion 15 for attaching a plurality of fuses 11 and relay 12 are formed in two rows along a longitudinal direction of the cable portion 30. The connector portion 20 includes connector housings 22*a*, 22*b* formed of resin molded members, and case portions 23*a*, 23*b* in which the connector housings 22*a*, 22*b* are partially contained and which can be divided in a thickness direction of the cable portion 30. The connector portion is disposed in the other end of the cable portion 30. The connector housings 22*a*, 22*b* include a plurality of connector engagement portions 25 which are arranged along opposite side edges of the cable portion 30, and into which plug connectors 21*a*, 21*b* are inserted (arranged) from opposite sides.

Figure 2:
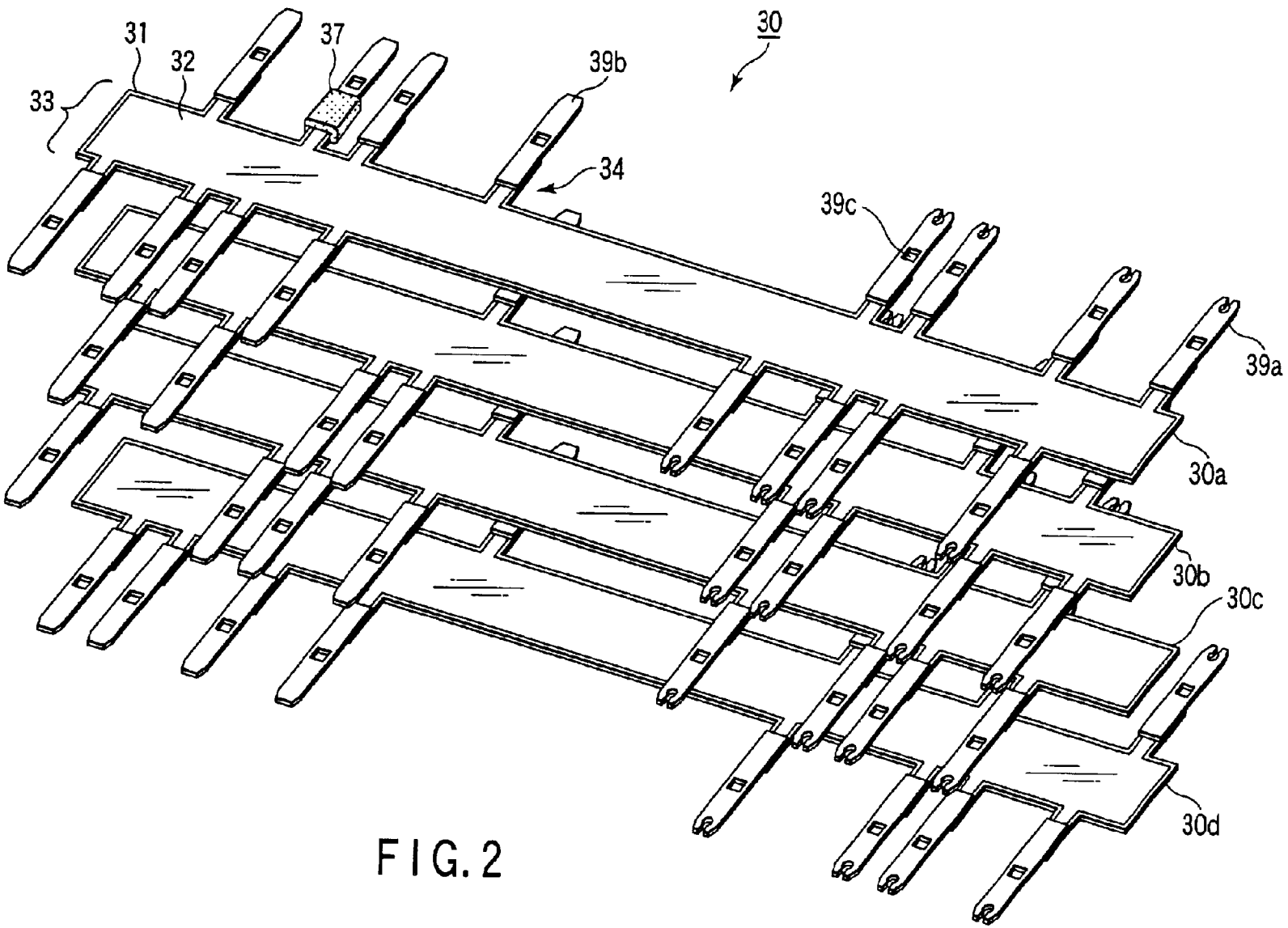
FIG. 2 is an exploded perspective view showing a constitution of a cable portion.

FIG. 2 is an exploded perspective view showing a constitution of the cable portion 30. Additionally, the cable portion 30 may also be constituted of one FPC, but in this example a plurality of FPCs superimposed upon one another in the non-bonded state will be described.

First, each of the strip-shaped FPCs 30*a*, 30*b*, 30*c*, 30*d* constituting the cable portion 30 is constituted by disposing a circuit portion 32 formed by patterning a conductor material such as a copper foil on a base film 31 made of an insulating film such as polyethylene terephthalate (PET), polyethylene naphthalate (PEN) and polyimide (PI). If necessary, a cover layer (not shown) is added onto this structure.

A plurality of terminal connecting portions 34 are formed so as to extend from opposite side edges of a strip portion 33 of each of the FPCs 30*a* to 30*d* by predetermined lengths in a short direction of the strip portion 33. Each tip end of these terminal connecting portions 34 is connected to: a connecting terminal 39*a* (hereinafter referred to as a "first connecting terminal") which is contained in the junction box housing 13, constitutes a part of the junction box main body 10, has a metal plate shape and is disposed on a side of the junction box main body; and a connecting terminal 39*b* (hereinafter referred to as a "second connecting terminal") which is contained in the connector housing 22*a* (22*b*), constitutes a part of the connector portion 20, has a metal plate shape and is disposed on a side of the connector portion 20. Additionally, in this example, the first connecting terminal 39*a* is a so-called fork terminal whose tip end is branched into two, holds legs (connecting portions) of the fuses 11 and relay 12 between opposite surfaces of the branched tip end and achieves electric connection. The second connecting terminal 39*b* is a so-called male connecting terminal connected to each female connecting terminal (not shown) of the plug connectors 21*a*, 21*b*. Moreover, the terminal connecting portions 34 may also be formed only on one side edge of the strip portion 33. Furthermore, engagement holes 39*c* engaged with a lance mechanism disposed in the junction box housing 13 or the connector housing 22*a* (22*b*) as described later may also be formed in the first and second connecting terminals 39*a*, 39*b*.

Figure 3A:
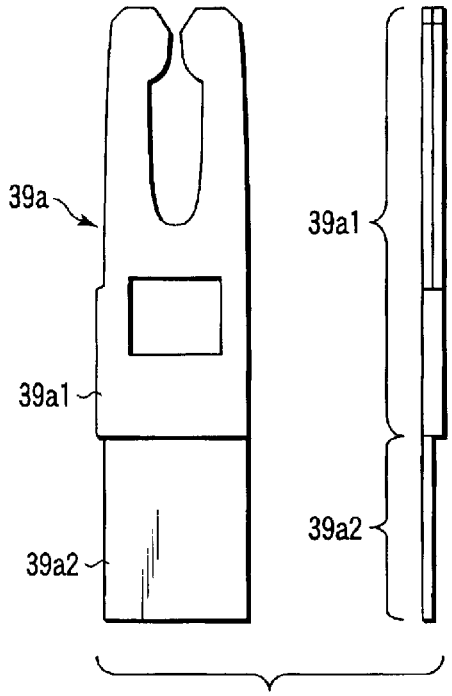
FIGS. 3A to 3D are explanatory views of a connecting terminal according to one embodiment of the present invention.
Figure 3B:
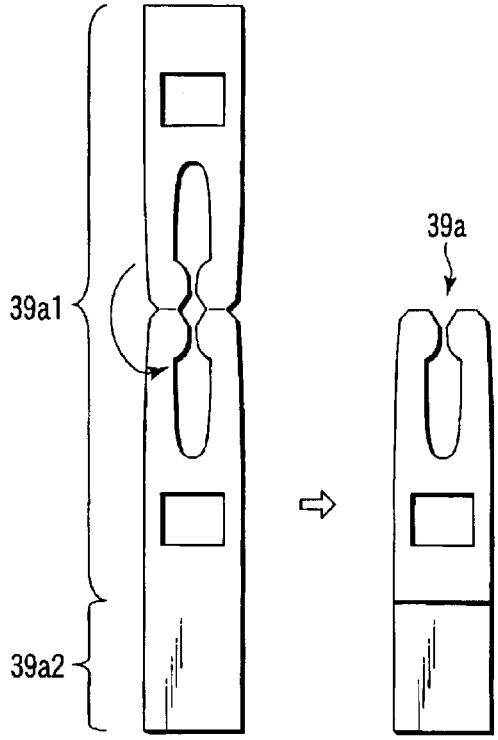
Figure 3C:
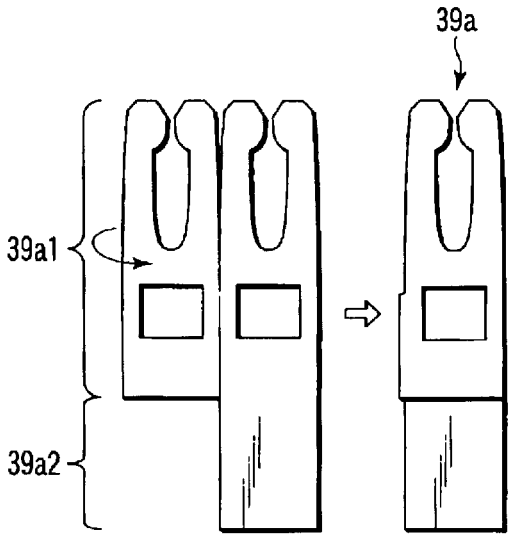
Figure 3D:
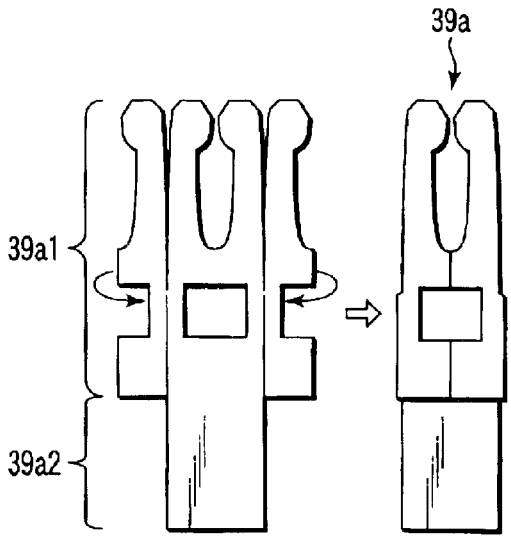
Figure 4B:
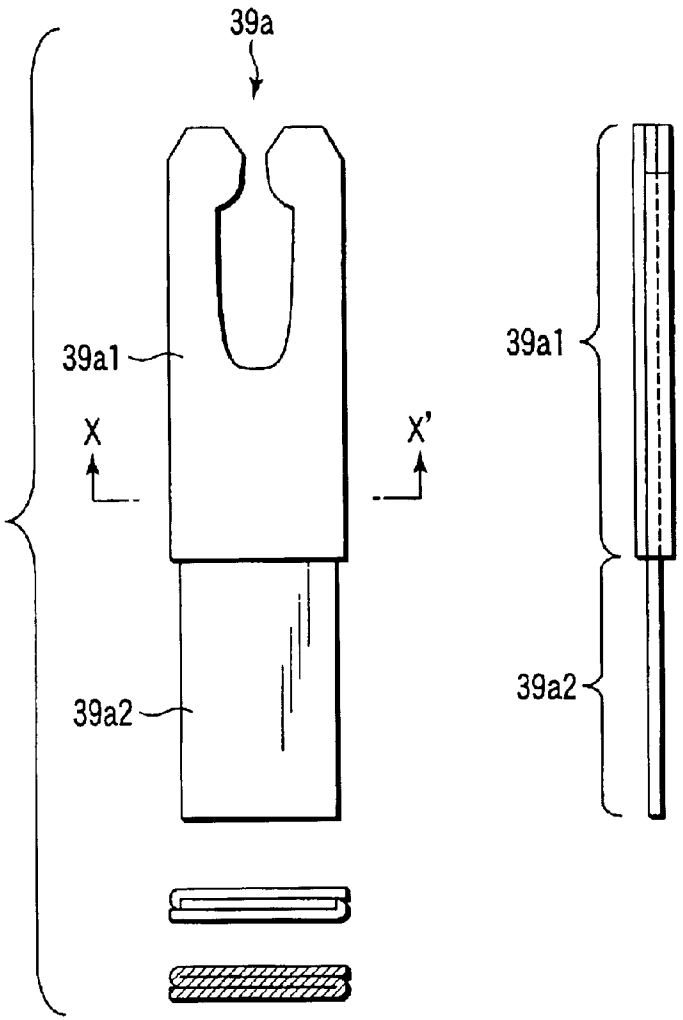
FIGS. 4A and 4B are explanatory views of the connecting terminal.
Figure 4A:
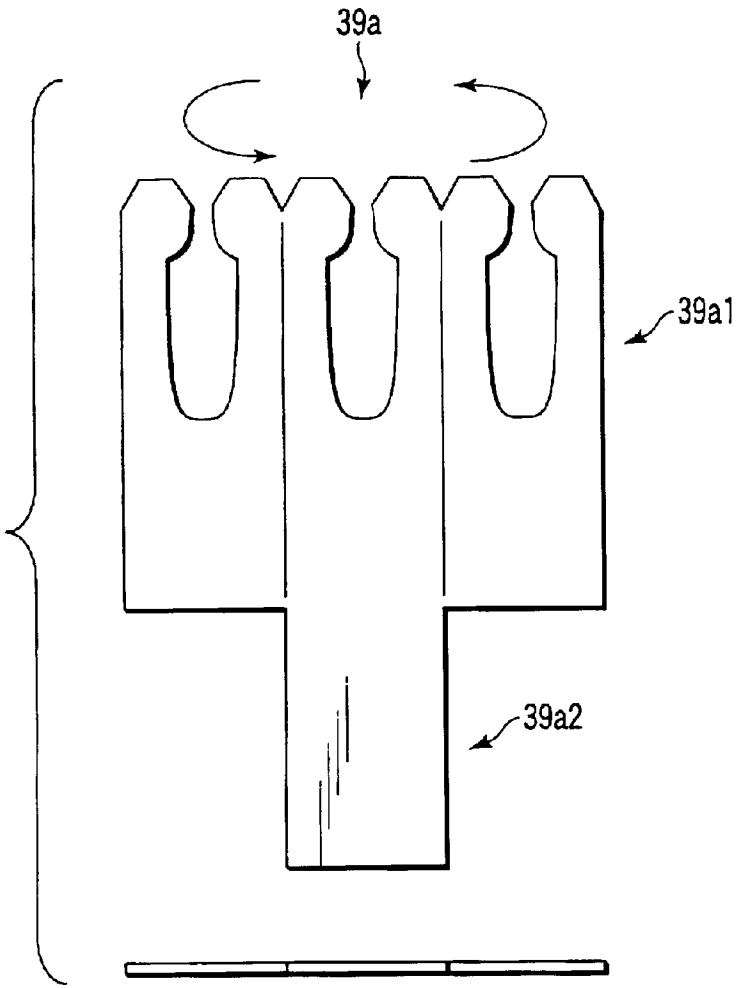
Figure 5A:
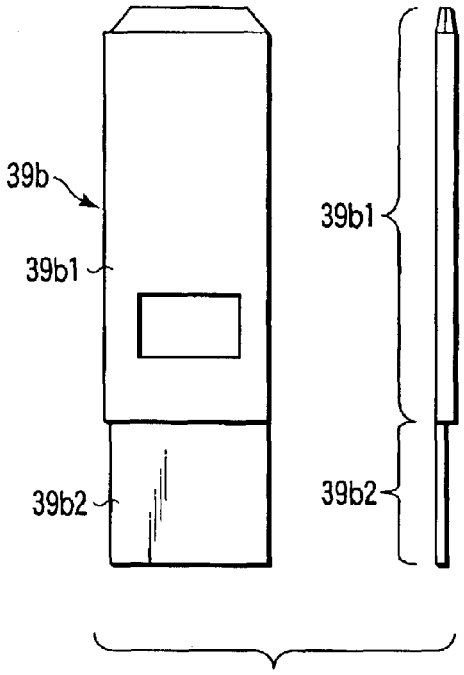
FIGS. 5A to 5D are explanatory views of the connecting terminal.
Figure 5B:
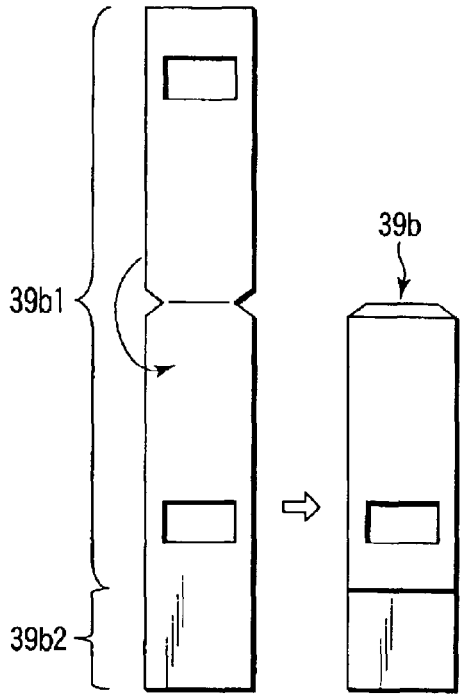
Figure 5C:
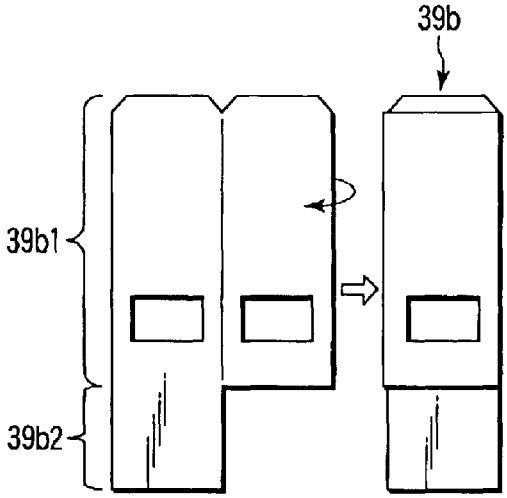
Figure 5D:
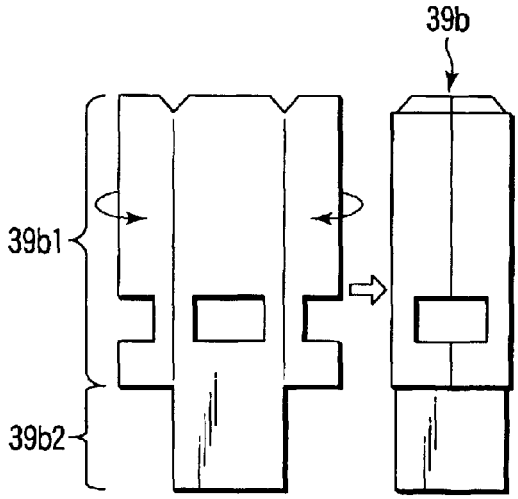
Figure 6B:
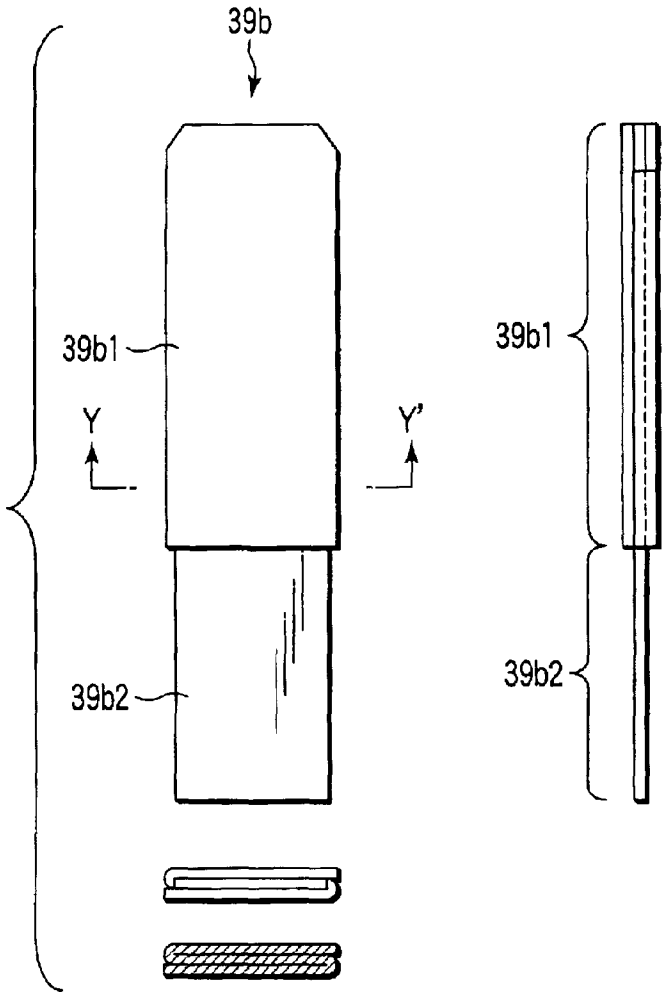
FIGS. 6A and 6B are explanatory views of the connecting terminal.
Figure 6A:
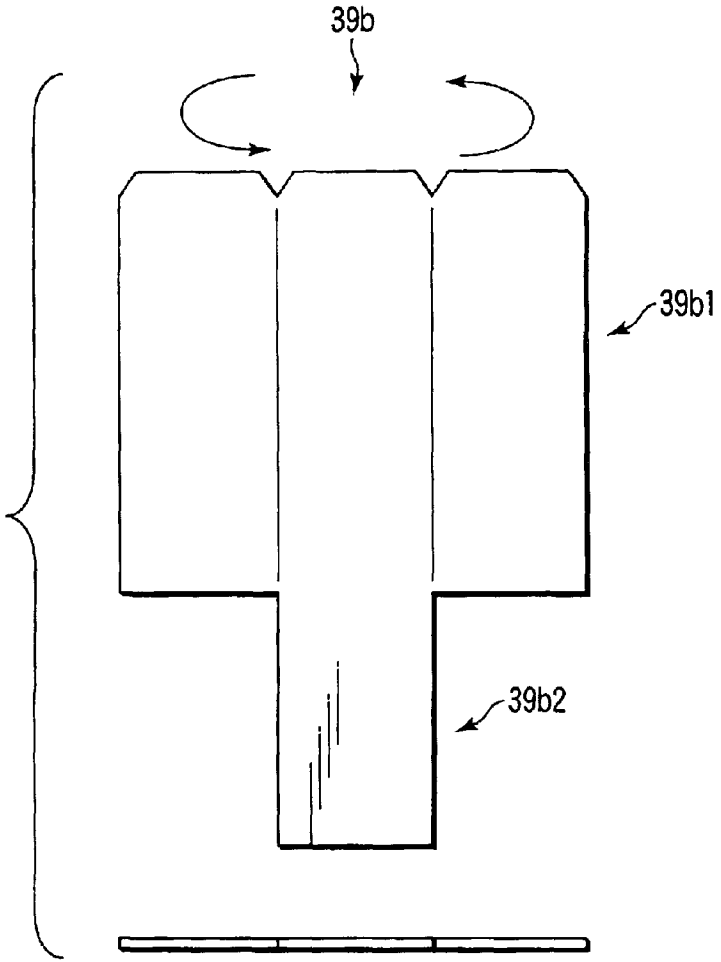

FIGS. 3 to 6 are explanatory views of the connecting terminals according to one embodiment of the present invention: FIG. 3 show detailed diagrams of the first connecting terminal 39*a*; FIG. 4 show diagrams of modification examples of FIG. 3; FIG. 5 show detailed diagrams of the second connecting terminal 39*b*; and FIG. 6 show diagrams of modification examples of FIG. 5.

As shown in FIGS. 3A and 5A, the first and second connecting terminals 39*a*, 39*b* include terminal portions 39*a*1, 39*b*1 directly connected to female connecting terminals of the fuses 11, relay 12, and plug connectors 21, and connecting ends 39*a*2, 39*b*2 connected to the circuit portions 32 of the terminal connecting portions 34 of the FPCs 30*a* to 30*d*. The terminal portions 39*a*1, 39*b*1 are formed to have a thickness two or more times the thickness of the connecting ends 39*a*2, 39*b*2 (in other words, the connecting ends 39*a*2, 39*b*2 are formed to have a thickness which is a half or less of the thickness of the terminal portions 39*a*1, 39*b*1). Examples of a method of forming the terminal portions 39*a*1, 39*b*1 include: a method of punching metal parent materials having the same thickness as the thickness of the connecting ends 39*a*2, 39*b*2 beforehand, arranging the portions constituting the connecting ends 39*a*2, 39*b*2 as such, bending the portions constituting the terminal portions 39*a*1, 39*b*1 in predetermined positions, and superimposing and forming the terminal portions as shown in FIGS. 3B to 3D and 5B to 5D; and a method of punching metal parent materials having the same thickness as the thickness of the terminal portions 39*a*1, 39*b*1 beforehand, arranging the portions constituting the terminal portions 39*a*1, 39*b*1 as such, lengthening the portions constituting the connecting ends 39*a*2, 39*b*2 with a press to be thin, and setting the thickness of the terminal portions to be two or more times the thickness of the connecting ends 39*a*2, 39*b*2. Moreover, as shown in FIGS. 4 and 6, the portions constituting the terminal portions 39*a*1, 39*b*1 are each bent in two positions and superimposed, and the terminal portions 39*a*1, 39*b*1 may also be formed to have the thickness about three times the thickness of the connecting ends 39*a*2, 39*b*2. The thickness of the connecting ends 39*a*2, 39*b*2 of the first and second connecting terminals 39*a*, 39*b* is set to be a half or less of the thickness of the terminal portions 39*a*1, 39*b*1 in this manner. Then, the connecting ends 39*a*2, 39*b*2 can securely be connected to the circuit portion 32, for example, by resistance welding with a less energy as compared with the connecting ends having the same thickness as that of the terminal portions 39*a*1, 39*b*1. Additionally, with the terminal portions 39*a*1, 39*b*1 having twice or more times the thickness of the connecting ends 39*a*2, 39*b*2, while a sufficient mechanical strength is obtained, contact areas and volumes of the terminal portions 39*a*1, 39*b*1 can be increased for the connection to the fuses 11 and relay 12. Therefore, heat values of the connecting terminals 39*a*, 39*b* and terminal connecting portions 34 by the turning-on of power can be reduced.

These first and second connecting terminals 39*a*, 39*b* are laid on the terminal connecting portions 34 so as to adhere to the circuit portion 32 on the terminal connecting portions 34, subsequently bonded to the circuit portion 32, for example, by the resistance welding and connected to the terminal connecting portions 34 as described above. After the first and second connecting terminals 39*a*, 39*b* are connected to the terminal connecting portions 34, the FPCs 30*a* to 30*d* are superimposed upon one another and constitute the cable portion 30. In this case, the terminal connecting portions 34 of the respective FPCs 30*a* to 30*d* are formed so that the first and second connecting terminals 39*a*, 39*b* are arranged in positions corresponding to connecting terminal arrangement positions of the junction box housing 13 and connector housing 22*a* (22*b*).

Figure 7:
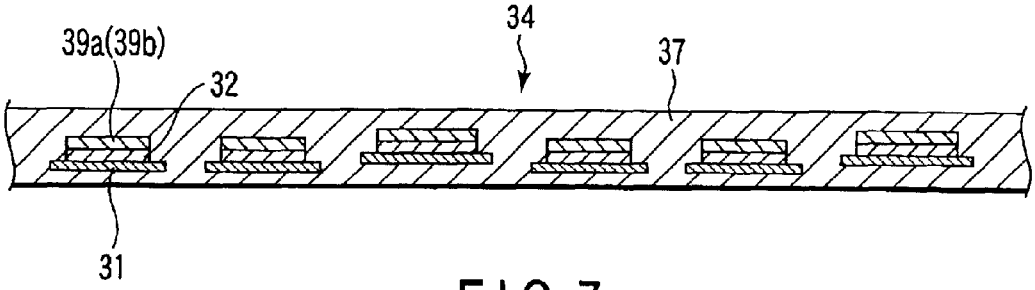
FIG. 7 is a sectional view of a resin molded portion.

After the strip-shaped FPCs 30*a* to 30*d* are superimposed upon one another and the cable portion 30 is formed in this manner, for example, each bonded portion of the connecting terminal 39*a* (39*b*) with the terminal connecting portion 34 is sealed by a resin molded portion 37. Then, connection reliability of the bonded portion can be enhanced. Additionally, as shown in FIG. 2, the resin molded portion 37 may also be formed for each bonded portion of each connecting terminal with the terminal connecting portion (the bonded portion of the connecting terminal 39*b* with the terminal connecting portions 34 in this example). However, as shown in FIG. 7, the bonded portions of a plurality of connecting terminals 39*a* (39*b*) to the terminal connecting portions 34 may collectively be sealed by the resin molded portion 37. In this case, while the arrangement of the connecting terminals 39*a* (39*b*) is fixed in a predetermined mode, the strip portions 33 of the respective FPCs 30*a* to 30*d* are held in the non-bonded state, and the cable portion 30 can be constituted. Therefore, while the flexibility of the cable portion 30 is maintained, the connecting terminals 39*a* (39*b*) can collectively be inserted into the junction box housing 13 and connector housing 22*a* (22*b*), and the inserting operation can be simplified. Moreover, the terminal connecting portions 34 connected to the second connecting terminals 39*b* are arranged as such. For the terminal connecting portions 34 connected to the first connecting terminals 39*a*, each first connecting terminal 39*a* is bent such that the terminal extends in a vertical direction with respect to the surface of the cable portion 30 with the circuit portion 32 formed thereon, and is contained in a predetermined connecting terminal arrangement position of the junction box housing 13. Then, the first connecting terminal 39*a* is attached to the junction box housing 13, and the second connecting terminal 39*b* is attached to the connector housing 22*a* (22*b*).

Figure 8:
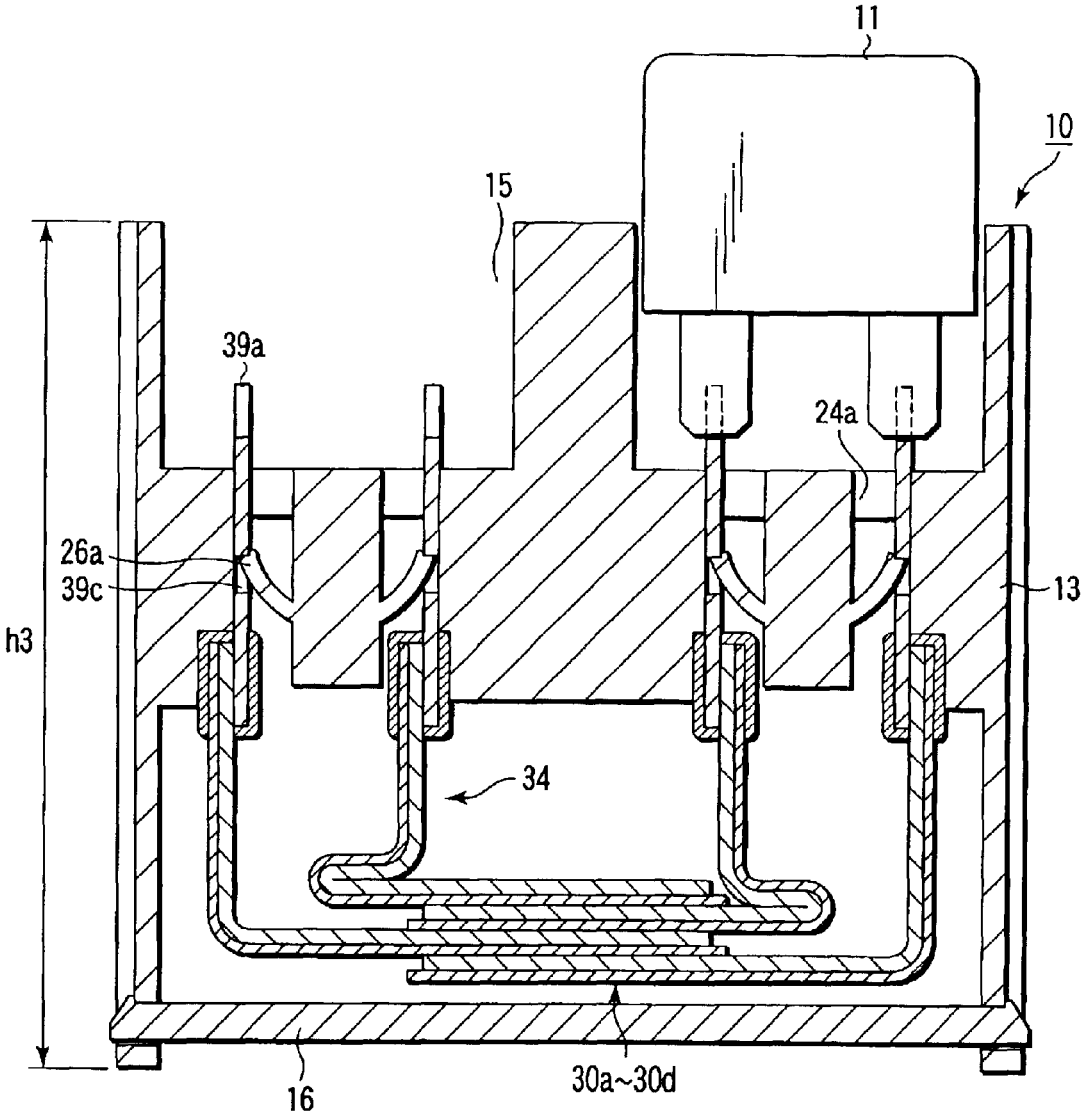
FIG. 8 is a partially sectional view showing that the connecting terminal is attached to a junction box housing.
Figure 9:
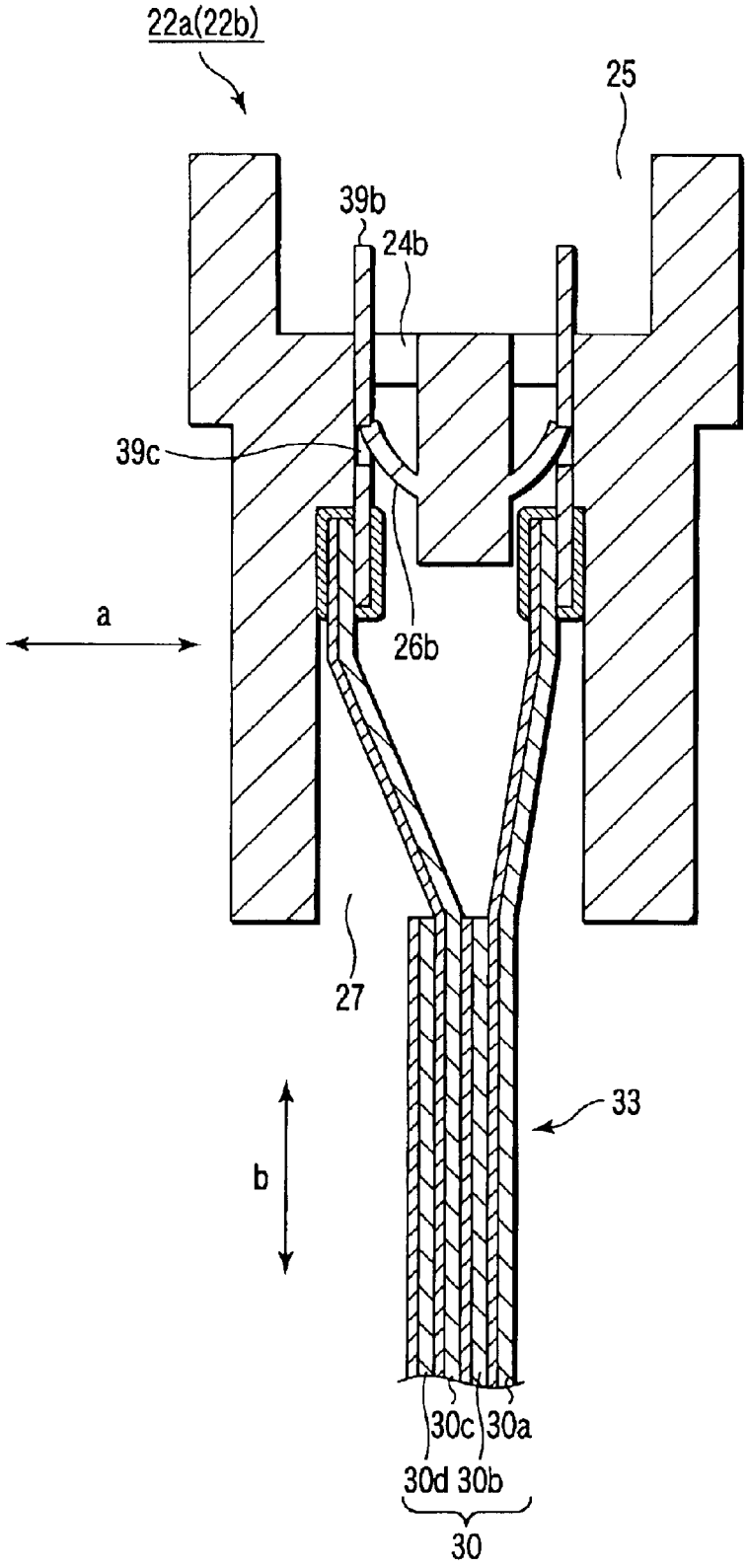
FIG. 9 is a partially sectional view showing that the connecting terminal is attached to a connector housing.

FIG. 8 is a partially sectional view showing that the first connecting terminals 39*a* are attached to the junction box housing 13 of the junction box main body 10, and FIG. 9 is a partially sectional view showing that the second connecting terminals 39*b* are attached to the connector housing 22*a* (22*b*) of the connector portion 20.

As shown in FIG. 8, in predetermined positions of the junction box housing 13 of the junction box main body 10, there are formed: terminal containing holes 24*a* through which the first connecting terminals 39*a* are passed and in which the terminals having tip ends exposed are contained; and lance portions 26*a* as a lance mechanism which are engaged with engagement holes 39*c* of the first connecting terminals 39*a* and lock/fix the first connecting terminals 39*a* in the junction box housing 13. The FPCs 30*a* to 30*d* constituting the cable portion 30 are contained in the junction box housing 13 while the surfaces with the circuit portions 32 formed thereon are disposed in a two-dimensional manner and the terminal connecting portions 34 are bent in the vertical direction. In this manner, the terminal connecting portions 34 are bent and directed in a direction crossing at right angles to the main surfaces of the FPCs 30*a* to 30*d*, and the cable portion 30 is contained in the junction box main body 10 in a structure for locking/fixing the first connecting terminals 39*a* by the lance portions 26*a*. Then, a height h3 of the junction box main body 10 can be suppressed, the connecting terminals 39*a* connected to the flexible FPCs 30*a* to 30*d* are securely held, and a predetermined connection strength can be achieved.

On the other hand, as shown in FIG. 9, in the connector housing 22*a* (22*b*) of the connector portion (not shown), there are formed: the connector engagement portion 25 with which the connector (outer connector) of an outer wiring circuit (not shown) and plug connector 21*a* (21*b*) are engaged; a plurality of terminal containing holes 24*b* through which the second connecting terminals 39*b* are passed and in which the tip ends of the terminals projected into the connector engagement portion 25 are contained; and an insertion hole 27 into which the FPCs 30*a* to 30*d* having the second connecting terminals 39*b* passed through the terminal containing holes 24*b* and constituting the cable portion 30 are inserted in a side edge direction of the strip portion 33. In a plurality of terminal containing holes 24*b*, lance portions 26*b*, engaged with the engagement holes 39*c* of the second connecting terminals 39*b*, for locking/fixing the second connecting terminals 39*b* in the connector housing 22*a* (22*b*) are formed as the lance mechanism in predetermined positions. The respective FPCs 30*a* to 30*d* constituting the cable portion 30 are contained in the connector housing 22*a* (22*b*) so that a width a direction of the connector housing 22*a* (22*b*) crosses at right angles to a width b direction of the cable portion 30. When the cable portions 30 are attached to the respective housings 13, 22*a* (22*b*) and subsequently attached to the lid body 16 and case portion 23, the junction box 1 is completed as shown in FIG. 1.

For the first and second connecting terminals 39*a*, 39*b*, when the terminal connecting portions 34 are bent in desired shapes, the arrangement positions of the connecting terminals 39*a* (39*b*) are freely changed and it is possible to form the junction box 1 in a desired shape. A degree of design freedom can be enhanced. For example, as shown in FIG. 1, when the terminal connecting portions 34 extended in the short direction of the strip portion 33 are contained in the connector portion 20, a height h of the connector portion 20 can be remarkably lower than that of the conventional junction box, and space saving is possible.

Figure 10:
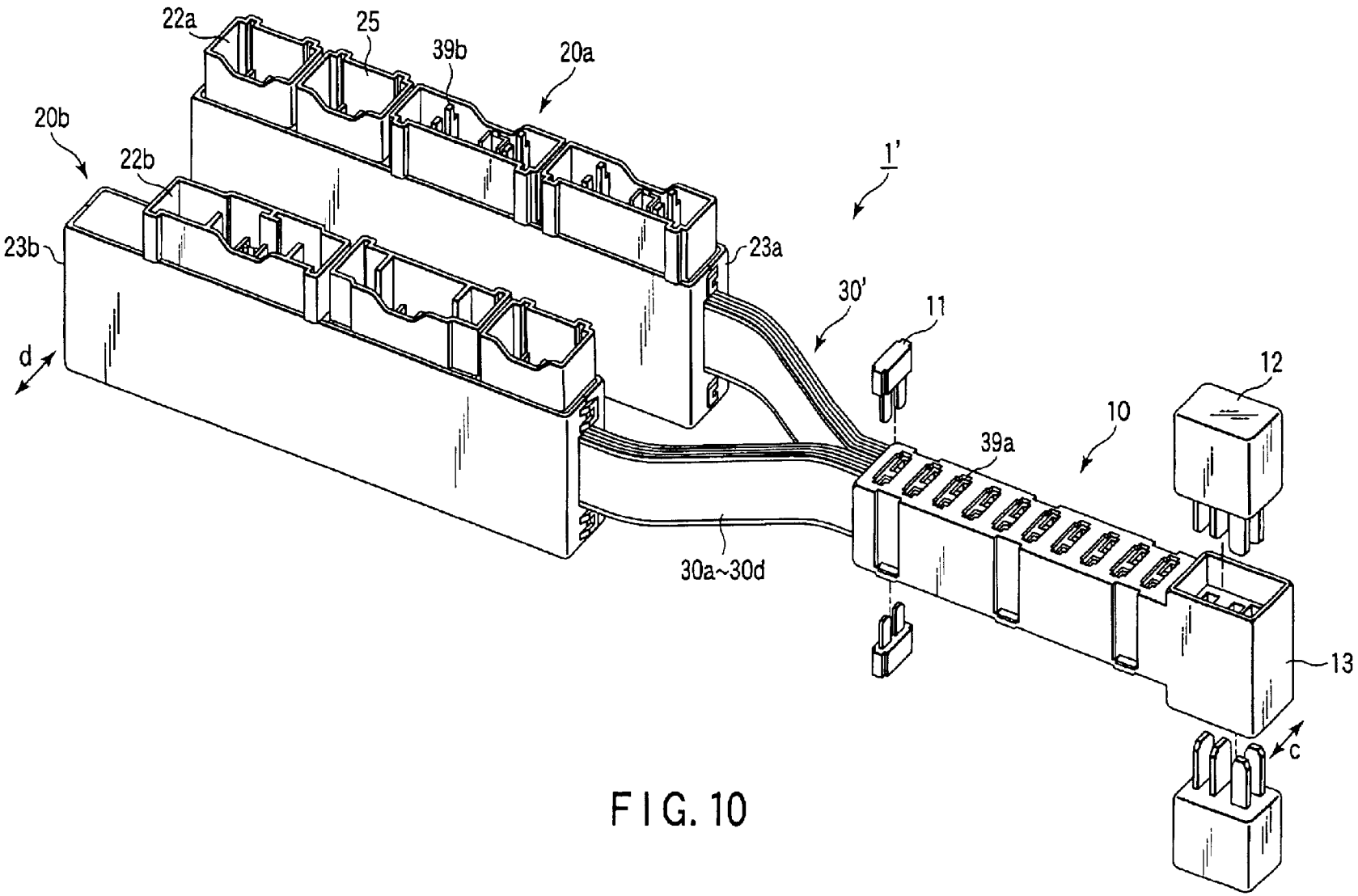
FIG. 10 is a perspective view showing the appearance of another junction box according to the embodiment.

FIG. 10 is a perspective view showing the appearance of another junction box according to the embodiment of the present invention.

A junction box 1' of this example is different from the junction box 1 according to the above-described embodiment in that a cable portion 30' is branched into two in a superimposition direction of the FPCs 30*a* to 30*d*, two connector portions 20*a*, 20*b* are disposed on branched ends, and the fuse attachment portion 14 and relay attachment portion 15 of a junction box main body 10' are inserted into opposite side edges of the cable portion 30' from opposite sides in each row. In the embodiment, each of the connector portions 20*a*, 20*b* includes the connector engagement portion 25 only in one side edge of the cable portion 30'.

FIGS. 11A to 14B are diagrams showing the constitution of the cable portion 30' of this example.

Figure 11A:
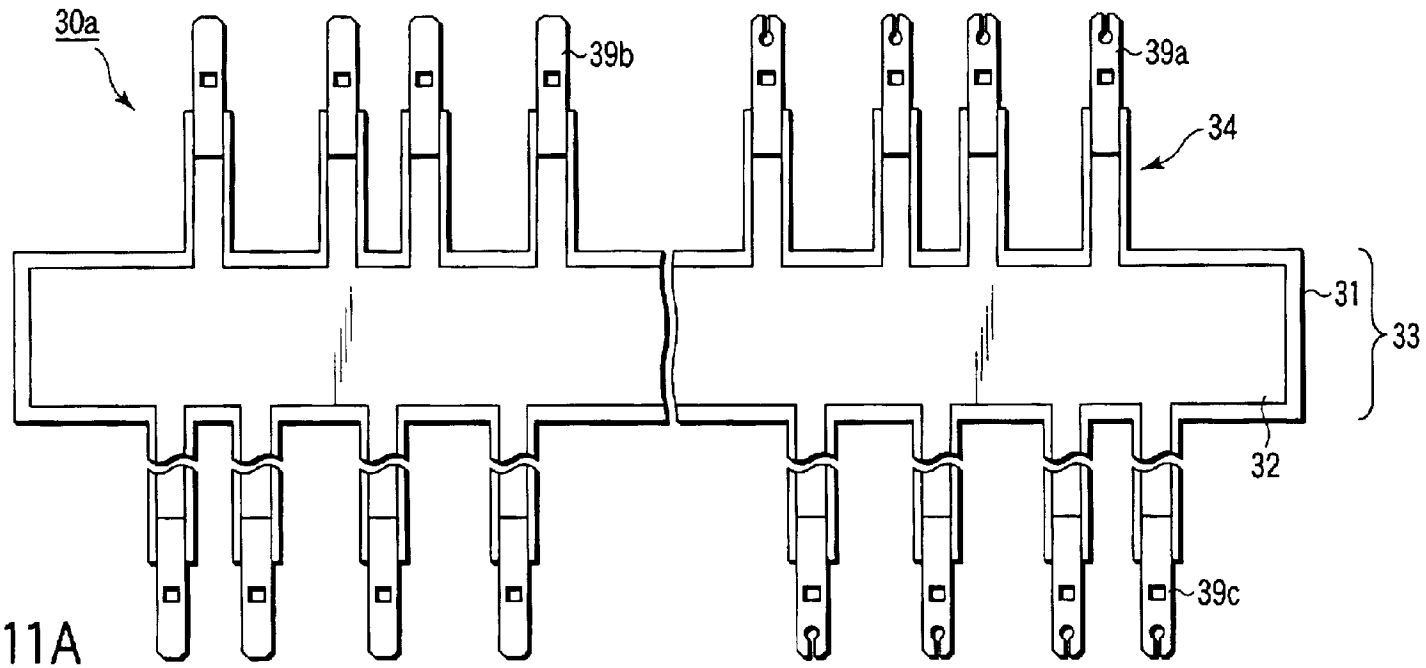
FIGS. 11A and 11B are diagrams showing a constitution of the cable portion of the junction box.

First, as shown in FIG. 11A, the strip FPC 30*a* constituting a part of the cable portion 30' is constituted by disposing the patterned/formed circuit portion 32 on the base film 31 formed of the insulating film such as PET, PEN and PI. Additionally, as not shown, the cover layer is formed on the constitution if necessary. A plurality of terminal connecting portions 34 are formed to extend in the short direction of the strip portion 33 by the desired length from opposite side edges of the strip portion 33 of the FPC 30*a*. For example, first and second connecting terminals 39*a*, 39*b* having metal plate shapes are connected to the tip ends of the terminal connecting portions 34. In this example, the terminal connecting portions 34 on one side are formed to be longer than the terminal connecting portions 34 on the other side. Additionally, the terminal connecting portions 34 may also be formed only on one side edge of the strip portion 33. Moreover, in the first and second connecting terminals 39*a*, 39*b*, the engagement holes 39*c* engaged with the lance mechanism disposed, for example, in a junction box housing 13*a* (13*b*) or the connector housing 22*a* (22*b*) are formed.

Figure 11B:
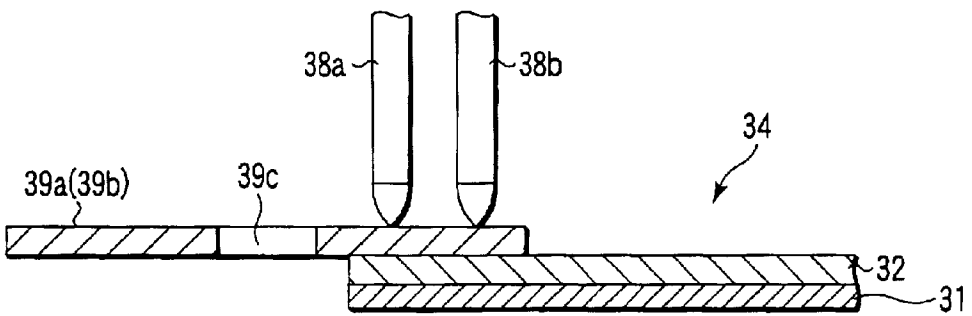

As shown in FIG. 11B, each connecting terminal 39*a* (39*b*) is disposed on the terminal connecting portion 34 so as to adhere to the circuit portion 32 on the terminal connecting portion 34. Thereafter, the terminal is subjected to the resistance welding by a pair of electrodes 38*a*, 38*b* of a series welding apparatus (not shown) allowed to abut on the terminal from above the connected portion with the circuit portion 32, bonded to the circuit portion 32 and connected to the terminal connecting portion 34. Additionally, since the resistance welding is a known technique, the description thereof is omitted. Additionally, the connecting terminal 39*a* (39*b*) may also be connected to the terminal connecting portion 34 by other methods such as ultrasonic welding, laser welding and soldering. When the terminals are connected to the portions in these connection methods, a high connection reliability can be secured.

Figure 12A:
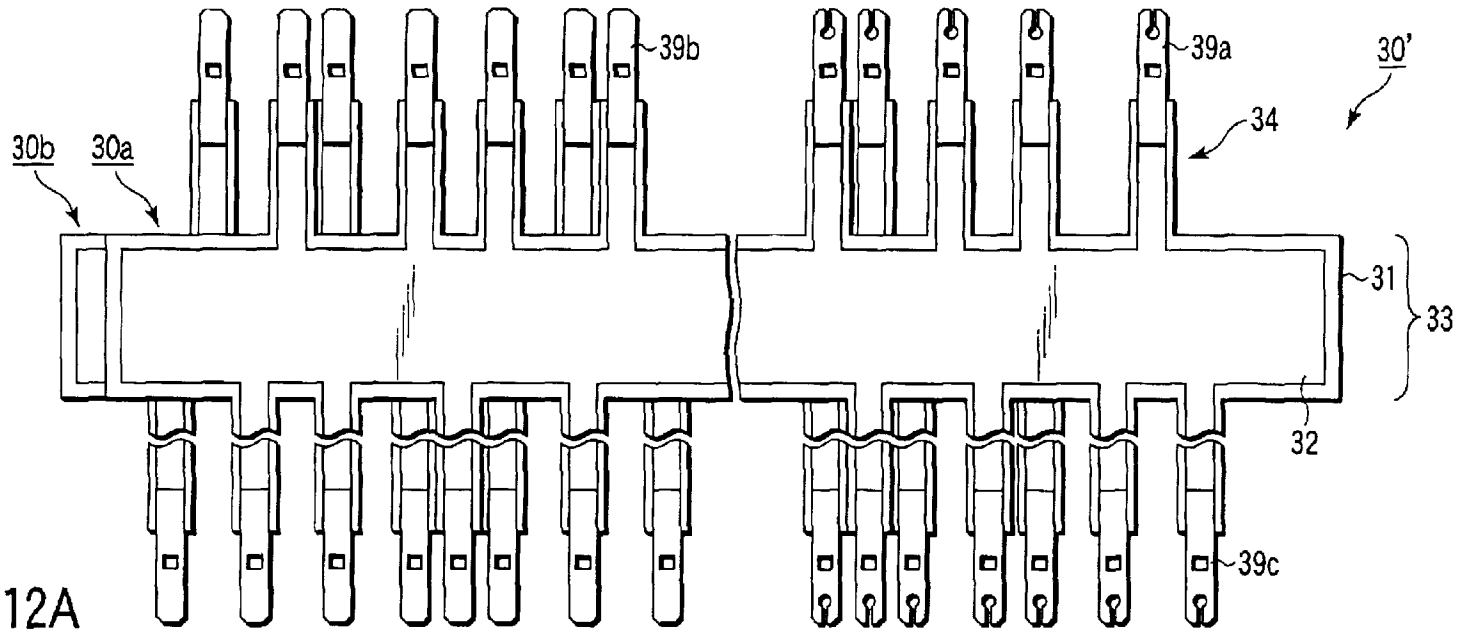
FIGS. 12A to 12C are diagrams showing the constitution of the cable portion of the junction box.
Figure 12C:
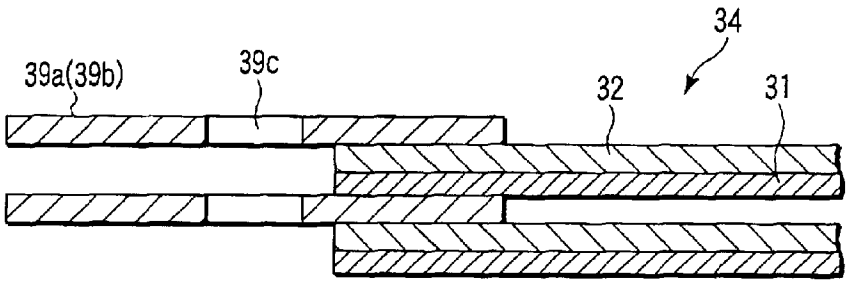
Figure 12B:
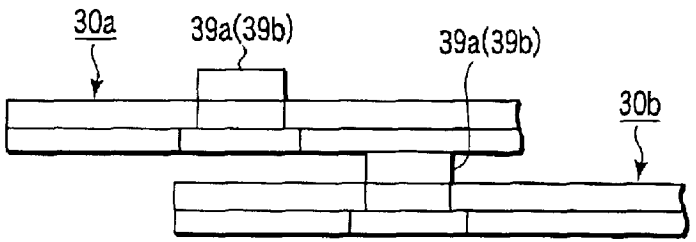

Subsequently, as shown in FIGS. 12A and 12B, the strip FPC 30*a* (30*b*) formed by connecting the connecting terminals 39*a* (39*b*) to the terminal connecting portions 34 in the method is superimposed to constitute the cable portion 30'. FIG. 12A is a top plan view showing the cable portion 30' constituted by superimposing the FPCs 30*a*, 30*b* upon each other, FIG. 12B is a partial side view of the cable portion 30', and FIG. 12C is a partial sectional view of the cable portion 30'. In this case, the terminal connecting portions 34 constituting the FPCs 30*a*, 30*b* constituting the cable portion 30' may be disposed and formed in the desired positions of the side edges of the strip portion 33 so that the connecting terminal 39*a* (39*b*) is disposed in a predetermined position corresponding to the connecting terminal arrangement position of the junction box housing 13*a* (13*b*) or the connector housing 22*a* (22*b*).

Figure 13A:
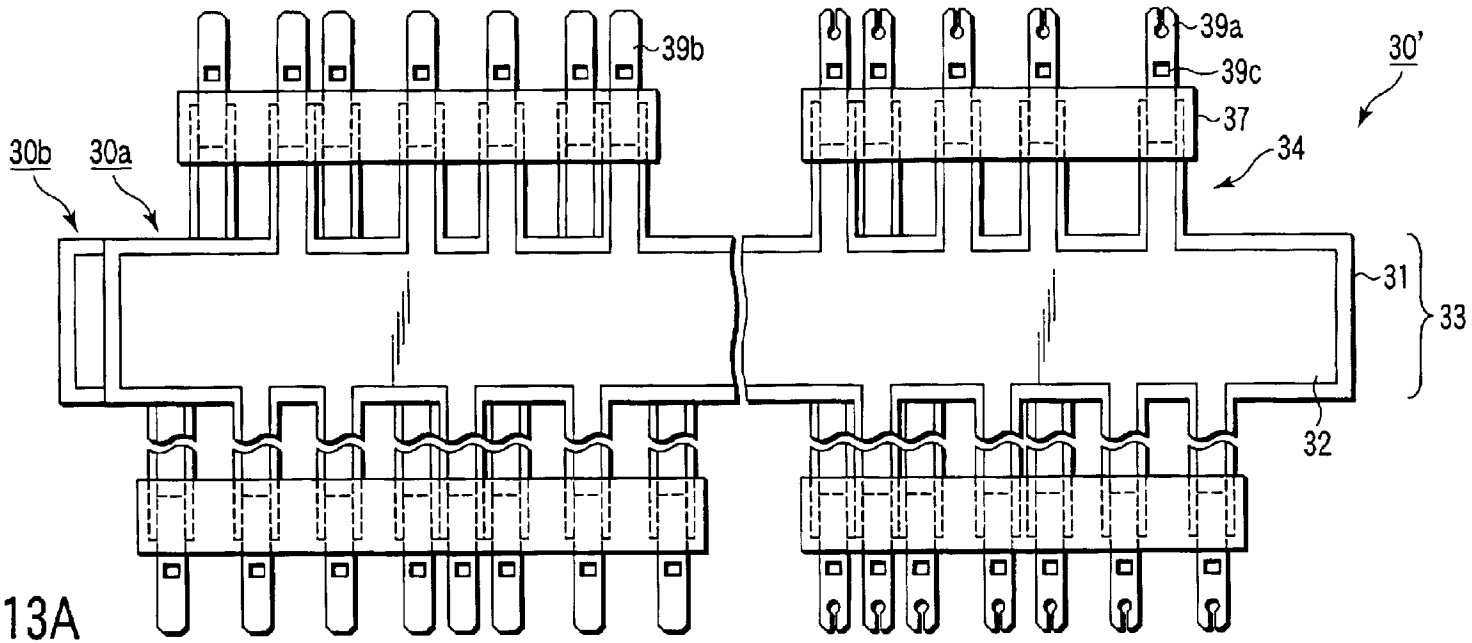
FIGS. 13A to 13C are diagrams showing the constitution of the cable portion of the junction box.
Figure 13C:
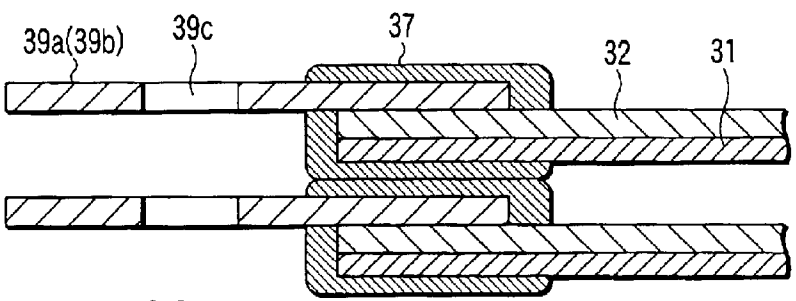
Figure 13B:
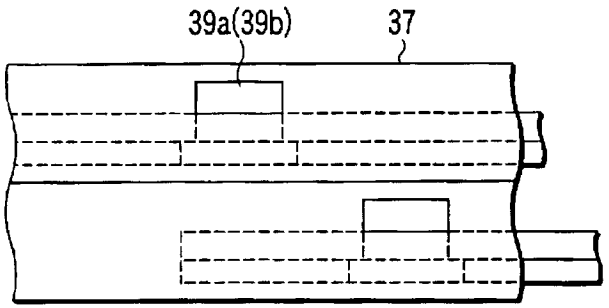

After a plurality of FPCs 30*a*, 30*b* are superimposed to form the cable portion 30' in this manner, as shown in FIGS. 13A and 13B, the connected portion of each connecting terminal 39*a* (39*b*) to the terminal connecting portion 34 is sealed by the resin molded portion 37. In this case, a certain number of connecting portions are collectively resin-molded at once as shown in FIG. 13A, the desired terminal arrangement state of the connecting terminals 39*a* (39*b*) can be realized without separating bonding the strip portions 33 of the FPCs 30*a*, 30*b* having the non-bonded states. Moreover, since the strip portions 33 of the FPCs 30*a*, 30*b* are not attached, it is possible to flexibly move the respective FPCs 30*a*, 30*b*. Furthermore, as not shown, the resin molded portions 37 which are independent of one another for the respective connected portions may also be formed as described above. FIG. 13A is a top plan view showing the cable portion 30' to which the resin mold is applied, FIG. 13B is a partial side view of the cable portion 30', and FIG. 13C is a partial sectional view of the cable portion 30'.

Figure 14A:
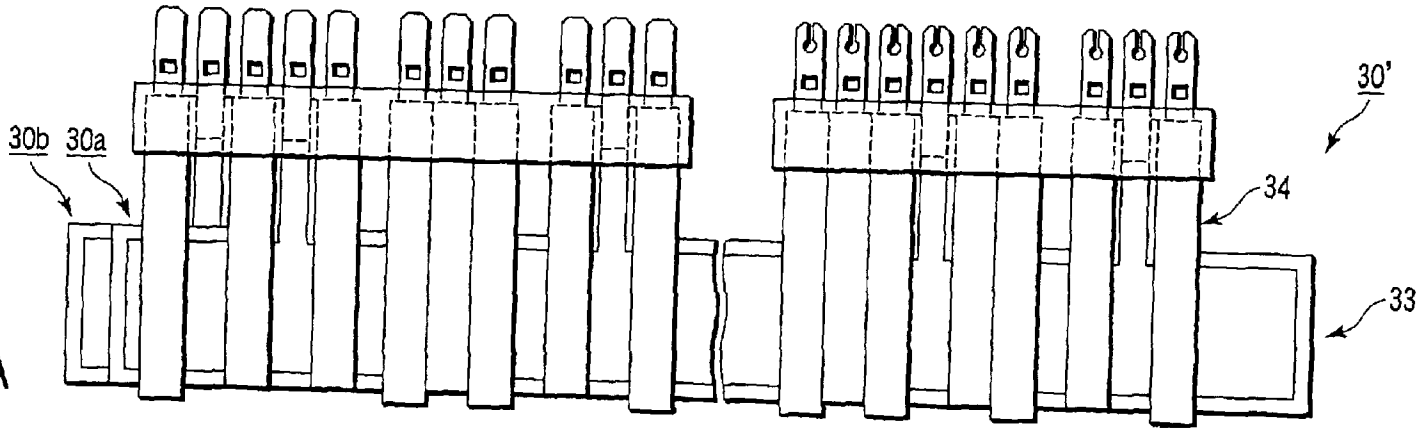
FIGS. 14A and 14B are diagrams showing the constitution of the cable portion of the junction box.
Figure 14B:
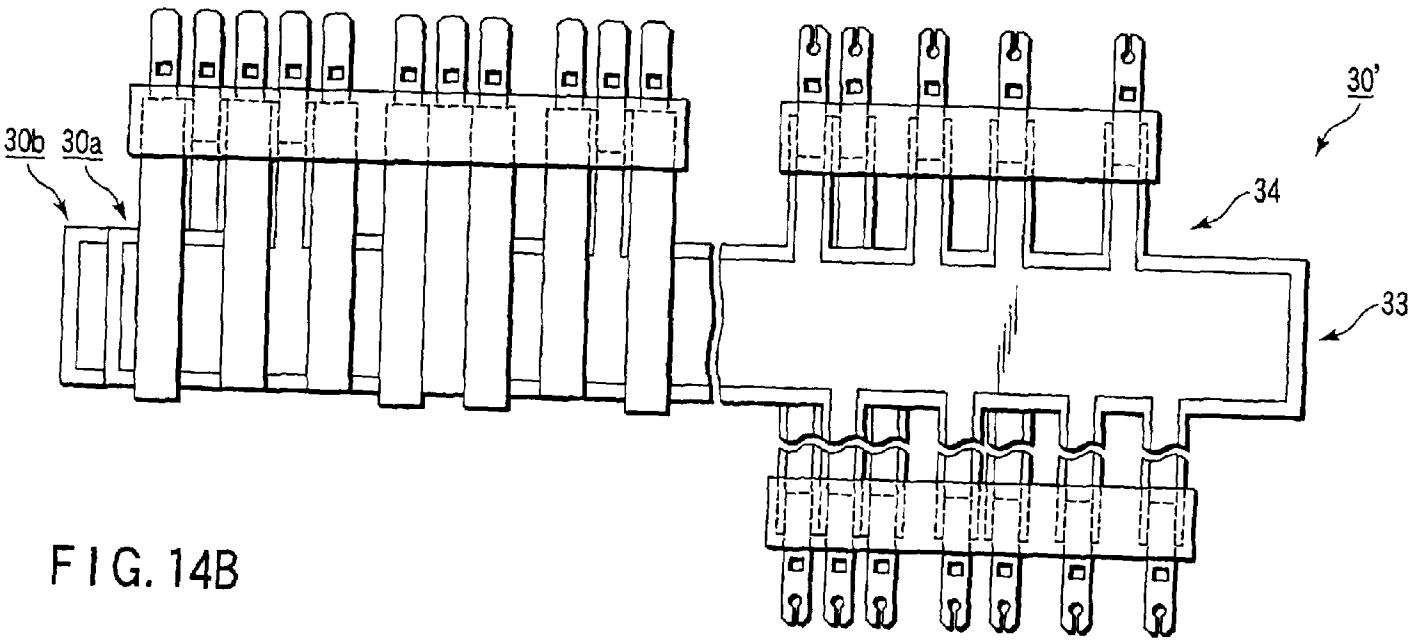

Additionally, as shown in FIG. 14A, for example, the terminal connecting portions 34 formed on one side edge of the strip portion 33 of the cable portion 30' formed in this manner are folded back on the side of the terminal connecting portions 34 formed in the other side edge. The terminal connecting portions 34 and connecting terminals 39*a* (39*b*) may also be disposed on one side edge of the cable portion 30' in a concentrated manner. As shown in FIG. 14B, for example, only the terminal connecting portions 34 formed on one side edge of the cable portion 30' to be contained in the connector portion 20*a* (20*b*) of the cable portion 30' may also be folded back toward the terminal connecting portions 34 formed on the other side edge to constitute the cable portion 30'. When the terminal connecting portions 34 and connecting terminals 39*a* (39*b*) are arranged on one side edge, the entire height and width of the junction box can be suppressed. When only some of the terminal connecting portions 34 and connecting terminals 39*a* (39*b*) are disposed on one side edge, as in the junction box 1' of this example, the height of one structure of the junction box main body 10' or the connector portion 20*a* (20*b*) is suppressed, and the connection is possible from an upward/downward direction in the other structure. Moreover, when the cable portion 30' in the state shown in FIGS. 12A and 12B are used, a width c of the junction box main body 10' and a width d of the connector portion 20*a* (20*b*) are reduced. In this case, a structure in which the connection from the upward/downward direction is possible both in the junction box main body and connector portion can be realized.

Figure 15:
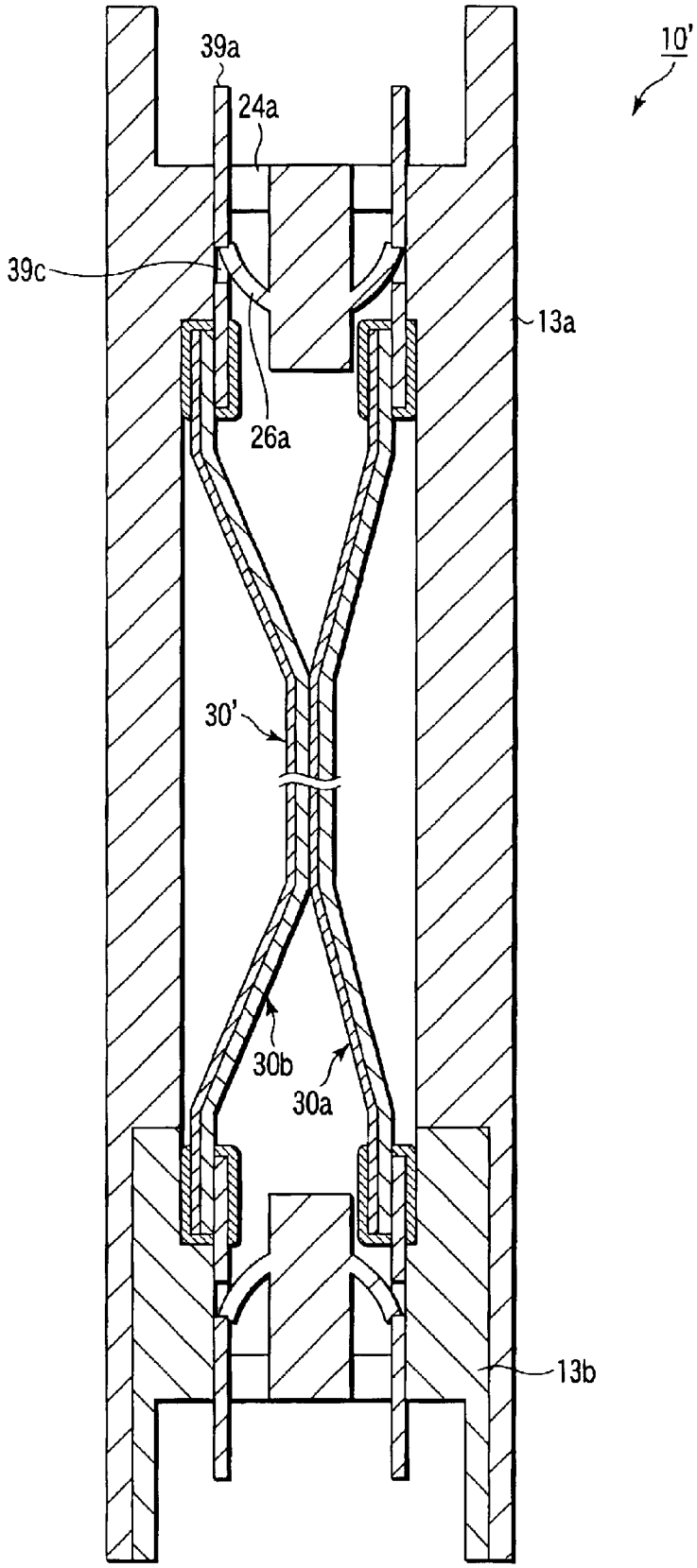
FIG. 15 is a partially sectional view showing that the connecting terminal is attached to the junction box housing.
Figure 16:
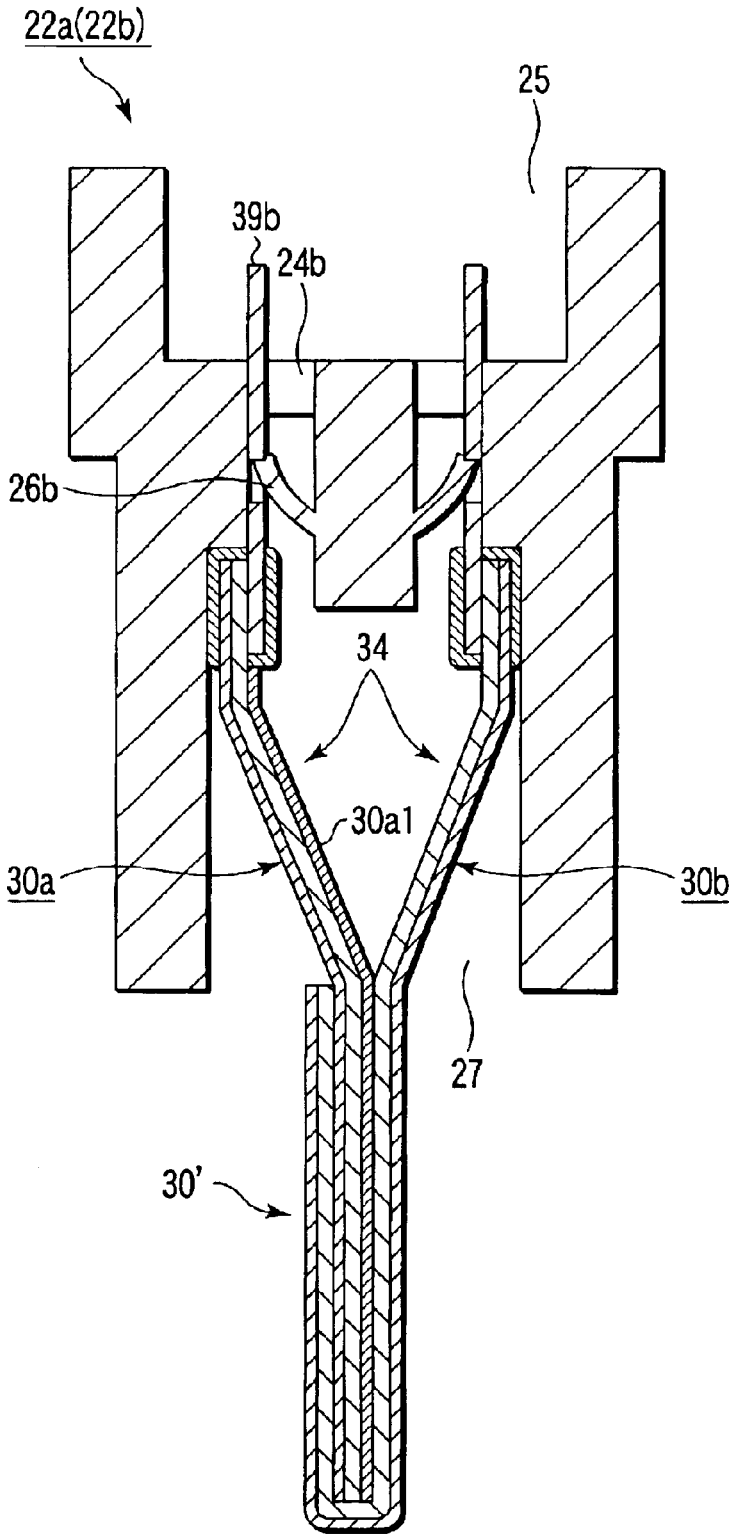
FIG. 16 is a partially sectional view showing that the connecting terminal is attached to the connector housing.

FIG. 15 is a partially sectional view showing that the first connecting terminals are attached to the junction box housings 13*a*, 13*b* of the junction box main body 10', and FIG. 16 is a partially sectional view showing that the second connecting terminals 39*b* are attached to the connector housing 22*a* (22*b*) of the connector portion 20*a* (20*b*).

As shown in FIG. 15, in the junction box housing 13*a* (13*b*) of the junction box main body 10', the terminal containing holes 24*a* through which the first connecting terminals 39*a* are passed and in which the terminals having tip ends exposed are contained, and the lance portions 26*a* as the lance mechanism which are engaged with the engagement holes 39*c* of the first connecting terminals 39*a* and lock/fix the first connecting terminals 39*a* in both the junction box housings 13*a*, 13*b* are formed in the predetermined positions. The junction box housings 13*a*, 13*b* are locked by a lock mechanism (not shown). When the mechanism is unlocked, the housings can be separated (for example, vertically divided) in the structure. The FPCs 30*a*, 30*b* constituting the cable portion 30' are contained in the junction box housings 13*a*, 13*b* while the surfaces with the circuit portions 32 formed thereon are longitudinally disposed and the terminal connecting portions 34 are extended as such from the opposite side edges.

On the other hand, as shown in FIG. 16, in the connector housing 22*a* (22*b*), there are formed: the connector engagement portion 25 which is engaged with the connector of the outer wiring circuit; a plurality of terminal containing holes 24*b* through which the second connecting terminals 39*b* are passed and in which the terminals having the tip ends projected in the connector engagement portion 25 are contained; and the insertion hole 27 into which the cable portion 30' having the second connecting terminals 39*b* passed through the terminal containing holes 24*b* is inserted in the side edge direction of the strip portion 33. In a plurality of terminal containing holes 24*b*, the lance portions 26*b*, engaged with the engagement holes 39*c* of the second connecting terminals 39*b*, for locking/fixing the second connecting terminals 39*b* in the connector housing 22*a* (22*b*) are formed in the predetermined positions. The terminal connecting portions 34 of the FPCs 30*a*, 30*b* constituting the cable portion 30' are contained in the insertion hole 27 in the connector housing 22*a* (22*b*) so that the terminal connecting portions constitute the predetermined connecting terminal arrangement positions in a state shown in FIG. 16. Additionally, since a cover layer 30*a*1 is disposed on the circuit portion 32 of the FPC 30*a*, the circuit portion is structured not to have a short circuit with the circuit portion 32 of the folded-back terminal connecting portion 34 of the FPC 30*b*.

Figure 17B:
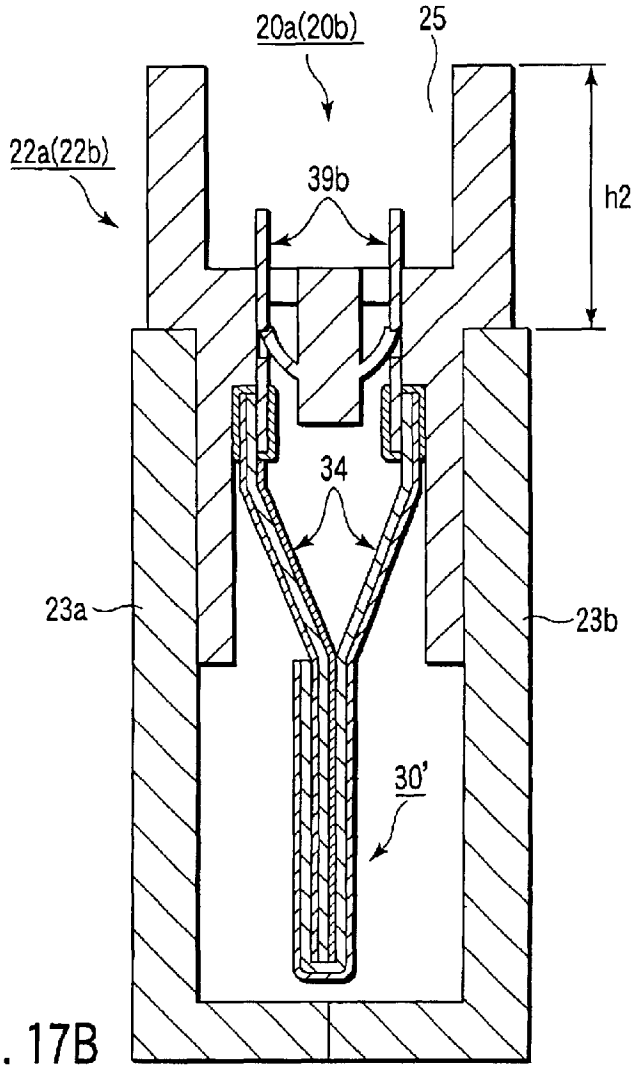
FIGS. 17A and 17B are partially sectional views of the connector portion, showing that connector housings having different shapes are used.
Figure 17A:
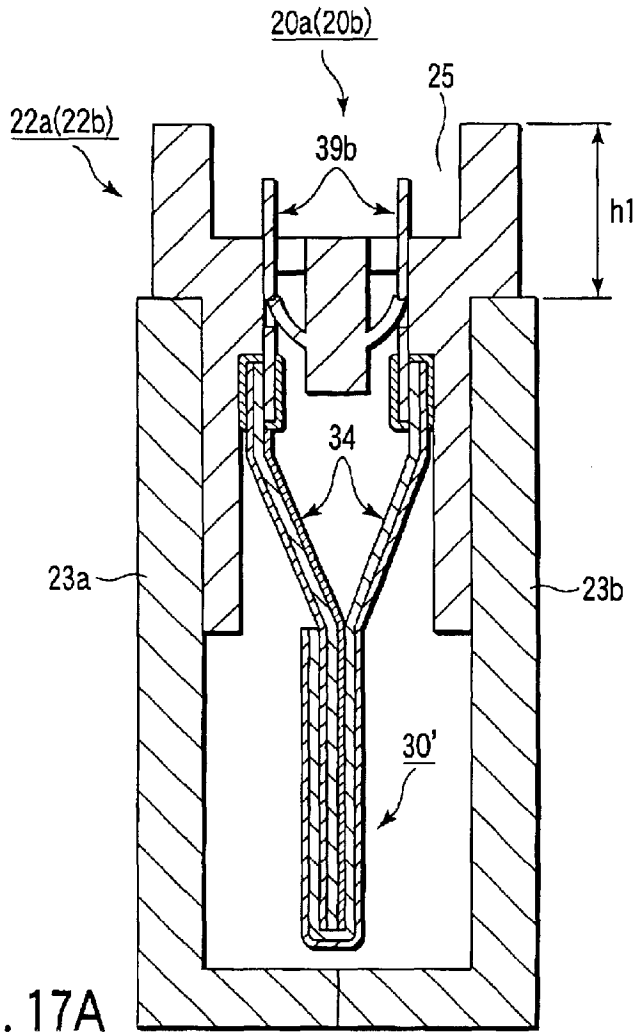

With the above-described attachment structure of the connecting terminal 39*b* to the connector housing 22*a* (22*b*), as shown in FIGS. 17A and 17B, when the connector housing 22*a* (22*b*) is just replaced with a housing having a different shape, the connector portion 20*a* (20*b*) can inexpensively be realized in accordance with various connector shapes. For example, a height h1 of an outer wall constituting the connector engagement portion 25 of the connector housing 22*a* (22*b*) shown in FIG. 17A is different from a height h2 of the outer wall constituting the connector engagement portion 25 of the connector housing 22*a* (22*b*) shown in FIG. 17B. Therefore, without changing the fold-back modes of the connecting terminals 39*b* and terminal connecting portions 34, cable portion 30' and case portion 23*a* (23*b*), it is possible to connect the connectors (outer connectors) of different types of outer wiring circuits, plug connectors 21*a*, 21*b*, and the like in accordance with the respective heights h1, h2. Thereby, it is possible to provide the junction box 1 for various connectors while the cost is suppressed.

Figure 18A:
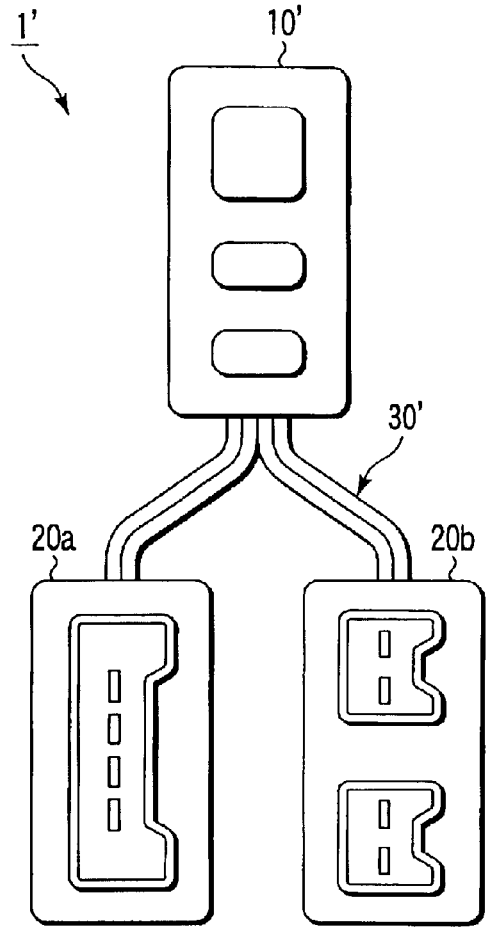
FIGS. 18A and 18B are a top plan view of the junction box, and a top plan view showing that a structure of the junction box is used to realize a junction box having an integral structure.
Figure 18B:
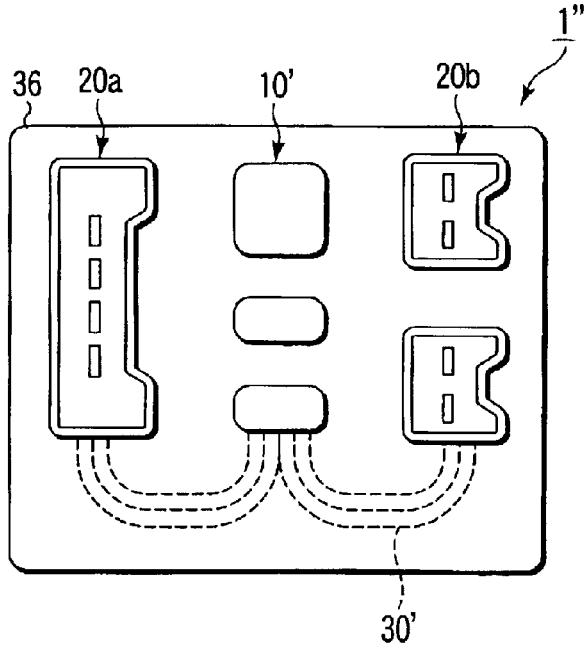

Additionally, the junction box 1 of this example includes a structure in which the junction box main body 10' is connected to the first and second connector portions 20*a*, 20*b* via the cable portion 30' including a plurality of flexible strip FPCs 30*a* to 30*d*. Therefore, as shown in FIG. 18A, of course, the junction box main body 10' and the connector portion 20*a* (20*b*) may be formed with different housings and connected to each other so that the respective housings can freely be moved via the cable portion 30'. Moreover, as shown in FIG. 18B, the junction box main body 10' and connector portion 20*a* (20*b*) are arranged in one housing 36, the cable portion 30' is contained in a connecting state of the junction box main body 10' to the first and second connector portions 20*a*, 20*b* in the housing 36, and a junction box 1" having an integral structure may be formed. When the cable portion 30' having flexibility is used, various types of junction boxes having different shapes can easily be realized at a low cost.

Moreover, not only the integral structure shown in FIG. 18B but also an integral structure shown in FIG. 19 may be used.

Figure 19A:
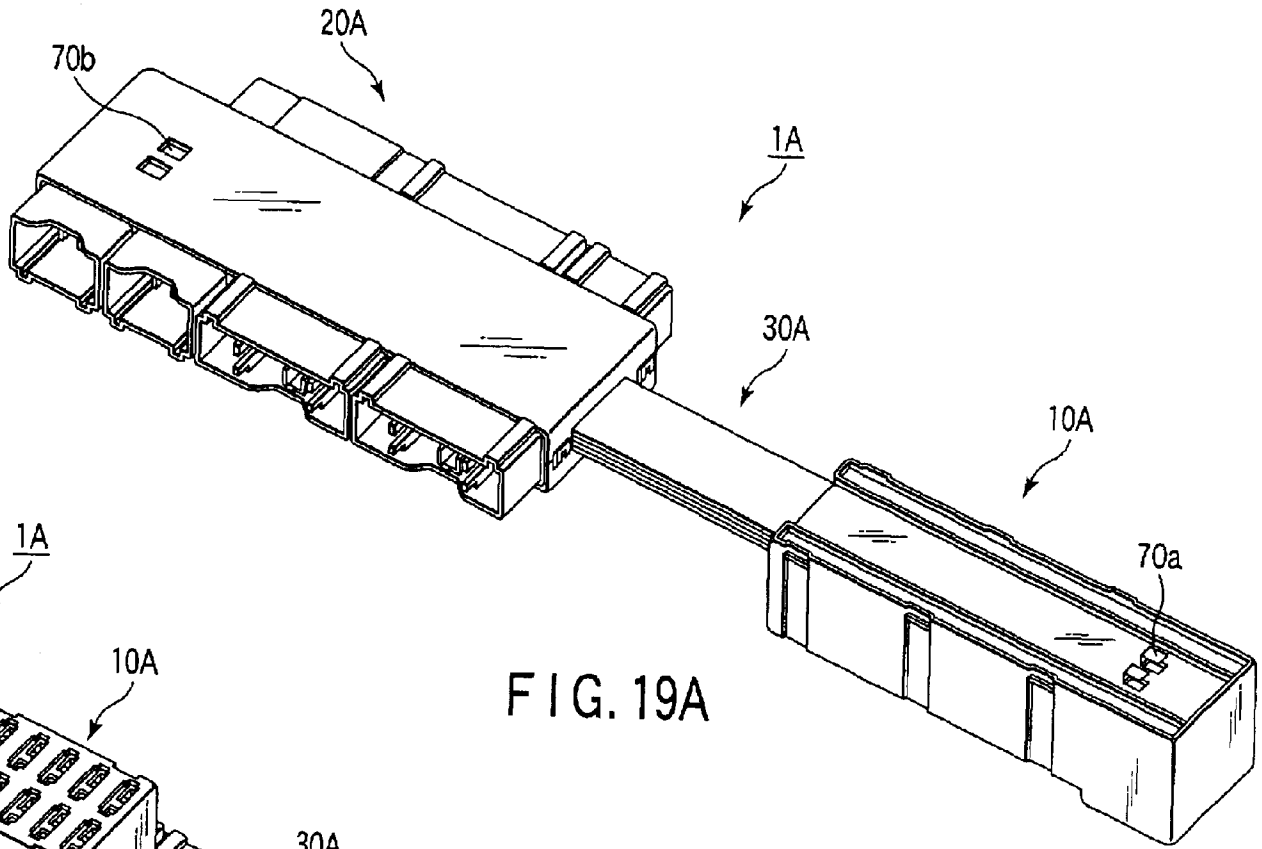
FIGS. 19A and 19B are perspective views showing the appearance of the junction box according to another embodiment of the present invention.
Figure 19B:
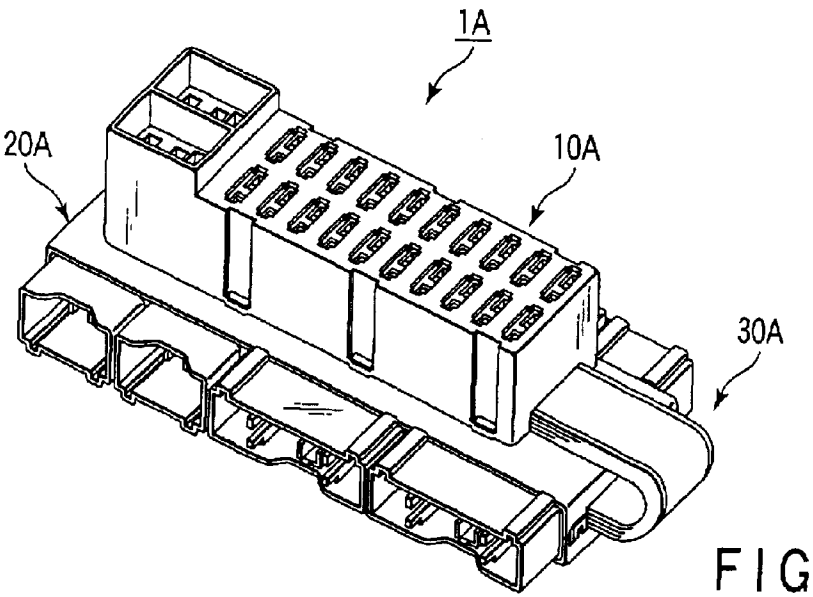

FIGS. 19A and 19B show perspective views of the appearance of the junction box according to another embodiment of the present invention.

That is, in the integral structure of this example, as shown in FIG. 19A, a junction box 1A in which a junction box main body 10A is connected to a connector portion 20A via a cable portion 30A is integrally fixed via a fixing mechanism 70 (70*a*, 70*b*) disposed in predetermined positions of the junction box main body 10A and connector portion 20A. The fixing mechanism 70 includes hooks 70*a* formed on a part of the lower surface of the junction box main body 10A, and hook engagement portions 70*b* formed in a part of a side part of the connector portion 20A. FIG. 19B shows that the hooks 70*a* formed on the junction box main body 10A are inserted in the hook engagement portions 70*b* formed in the connector portion 20A and both the main body and connector portion are integrally locked/fixed. As the fixing mechanism 70, for example, mechanisms shown in FIG. 20 are considered.

Figure 20A:
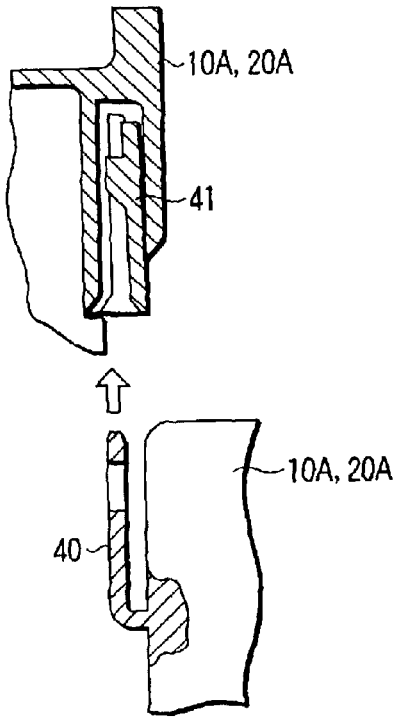
FIGS. 20A to 20D are explanatory views of various fixing mechanisms for use in the junction box.
Figure 20B:
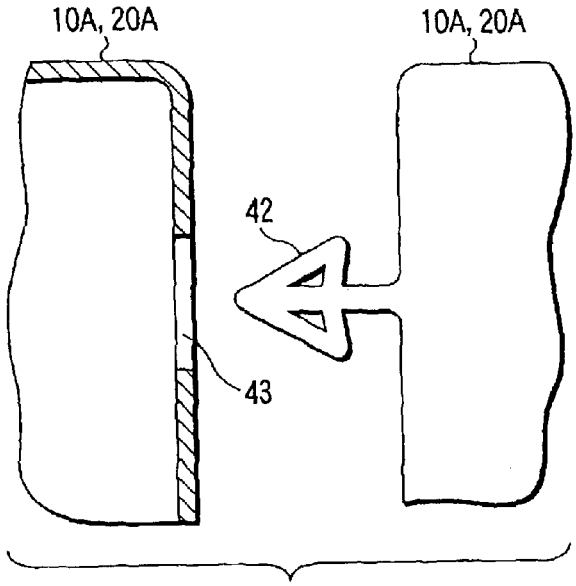

That is, as shown in FIGS. 20A and 20B, a metal bracket 40 is formed on the side surface of the housing or the case portion of either the junction box main body 10A or the connector portion 20A by an insert mold. A bracket engagement portion 41 to be engaged with the metal bracket 40 is formed in the side surface of the other housing. When the bracket is engaged with the bracket engagement portion, the junction box main body 10A and connector portion 20A are fixed by this fixing mechanism.

Moreover, as shown in FIG. 20B, a so-called anchor clip 42 is formed on the side surface of either one housing of the junction box main body 10A or the connector portion 20A by integral molding. An anchor clip fixing portion 43 including a hole to be engaged with the anchor clip 42 is formed in the side surface of the other housing. The anchor clip 42 is inserted in the anchor clip fixing portion 43 so that the junction box main body 10A and connector portion 20A are fixed by this fixing mechanism.

Figure 20C:
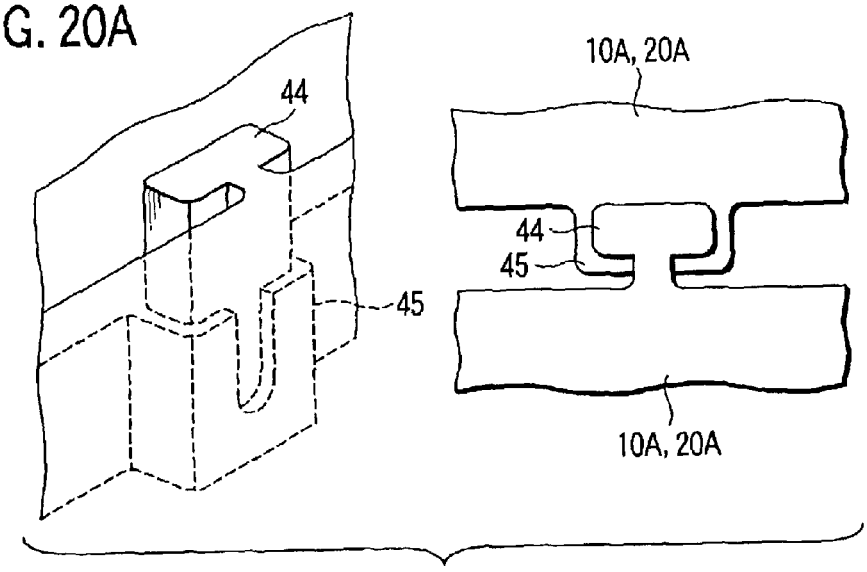

Furthermore, as shown in FIG. 20C, a rib 44 having a T-shaped section is formed on the side surface of one housing of either the junction box main body 10A or the connector portion 20A by the integral molding. A rib fixing portion 45 including a trench structure into which the rib 44 is slid, inserted and engaged is formed in the side surface of the other housing. The rib 44 is inserted into the rib fixing portion 45, and the junction box main body 10A and connector portion 20A are fixed by the fixing mechanism.

Figure 20D:
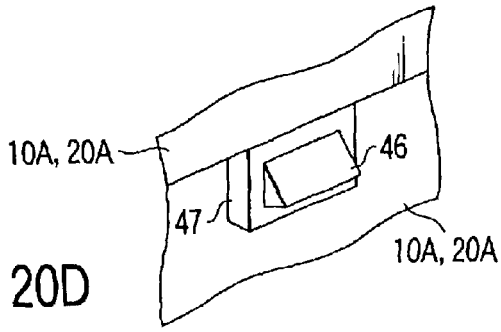

Additionally, as shown in FIG. 20D, a fixing protrusion 46 is formed in any one of the junction box main body 10A and connector portion 20A, and a lock piece 47 to be engaged with the protrusion 46 is formed in the other one. The protrusion is engaged with the piece so that the junction box main body 10A and connector portion 20A are fixed by the fixing mechanism. When these above-described fixing mechanisms 70 are formed beforehand in the housings of the junction box main body 10A and connector portion 20A, the modes of the junction box 1A including an independent structure and integrally coupled structure can easily be selected in a design stage. This makes it possible to enhance a freedom degree of layout of the junction box 1A. Additionally, other various fixing mechanisms for fixing the junction box main body 10A and connector portion 20A are considered, but the description thereof is omitted here. Moreover, needless to say, the above-described fixing mechanism 70 may also be used to fix a plurality of formed connector portions to one another.

Figure 21:
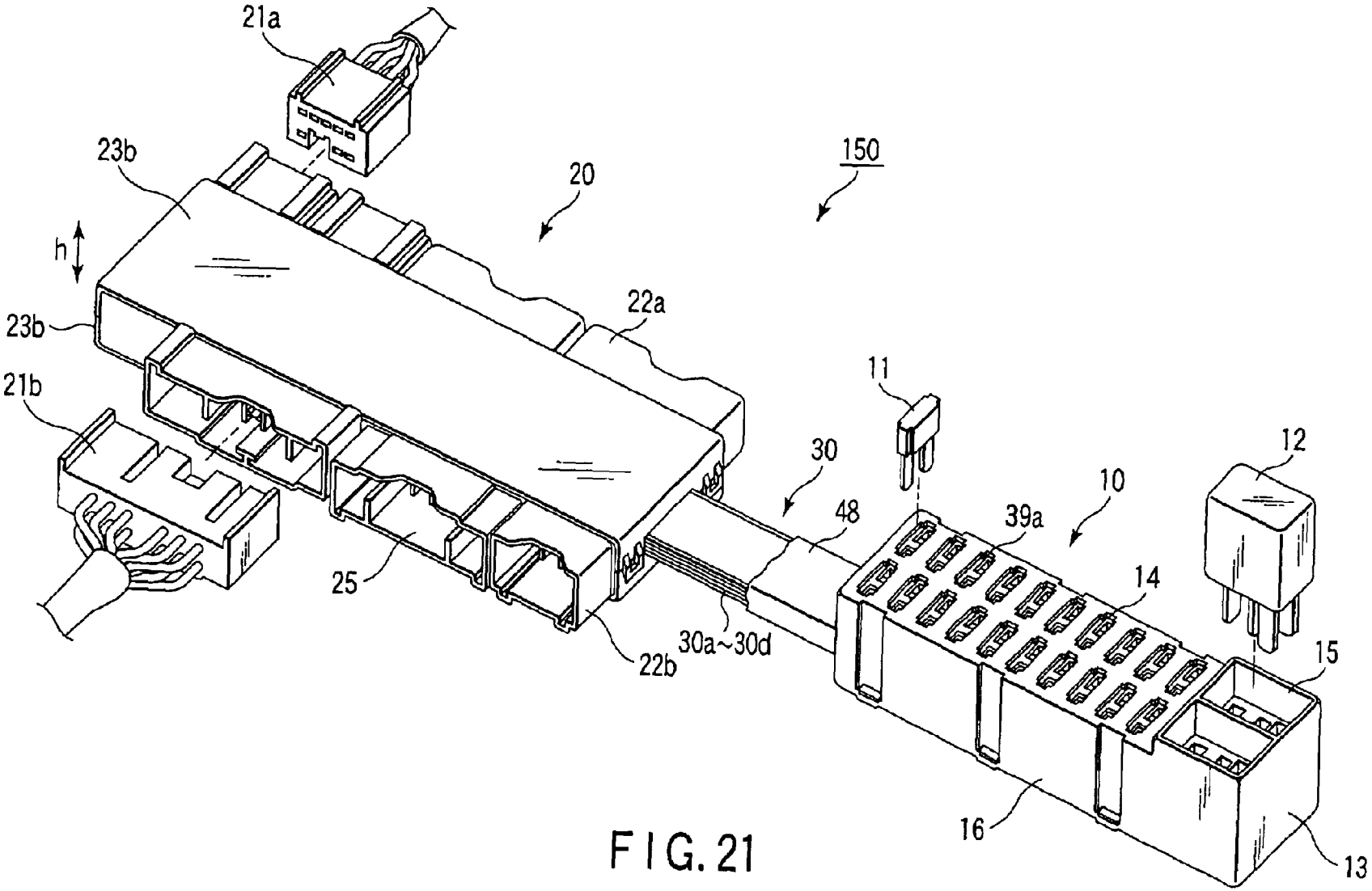
FIG. 21 is a perspective view showing the junction box according to another embodiment of the present invention.

FIG. 21 is a perspective view showing the appearance of the junction box according to still another embodiment of the present invention.

A junction box 150 of the embodiment is different from the junction box 1 of the above-described embodiment in that the cable portion 30 is passed through a flexible grommet 48 having a rectangular section (partially cut out and shown). The grommet 48 is formed of materials such as silicon rubber and ethylene propylene rubber (EPDM), and has high flexibility and durability. Since opposite ends of the grommet 48 are attached and fixed to the junction box main body 10 and the case portions 23*a*, 23*b* of the connector portion 20, the exposed portion of the cable portion 30 (portion between the junction box main body 10 and connector portion 20) is covered with the grommet 48.

Figure 22:
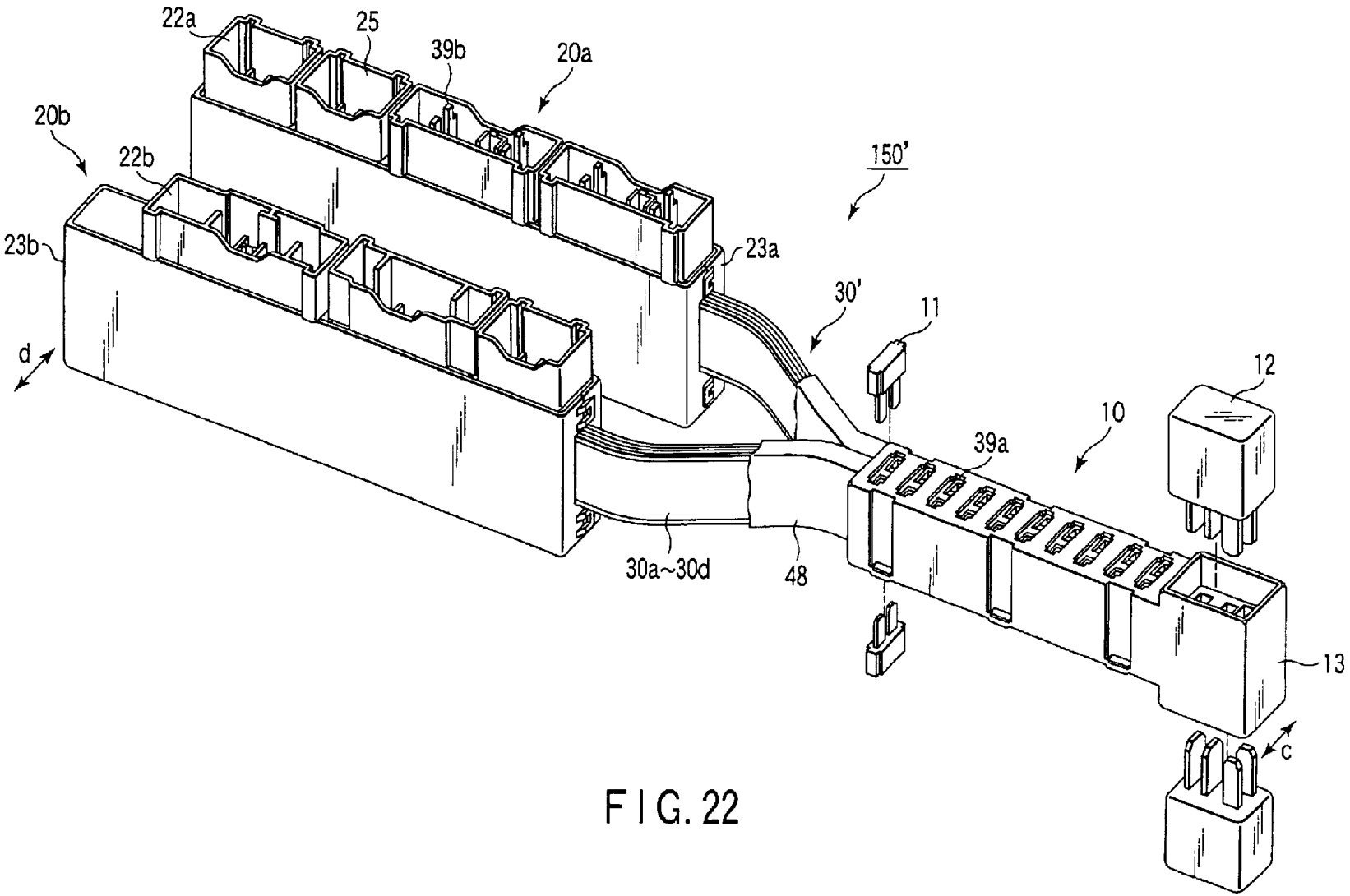
FIG. 22 is a perspective view showing the appearance of another junction box according to still further embodiment of the present invention.

FIGS. 22 and 23 are perspective views showing the appearance of another junction box according to still further embodiment of the present invention.

Figure 23A:
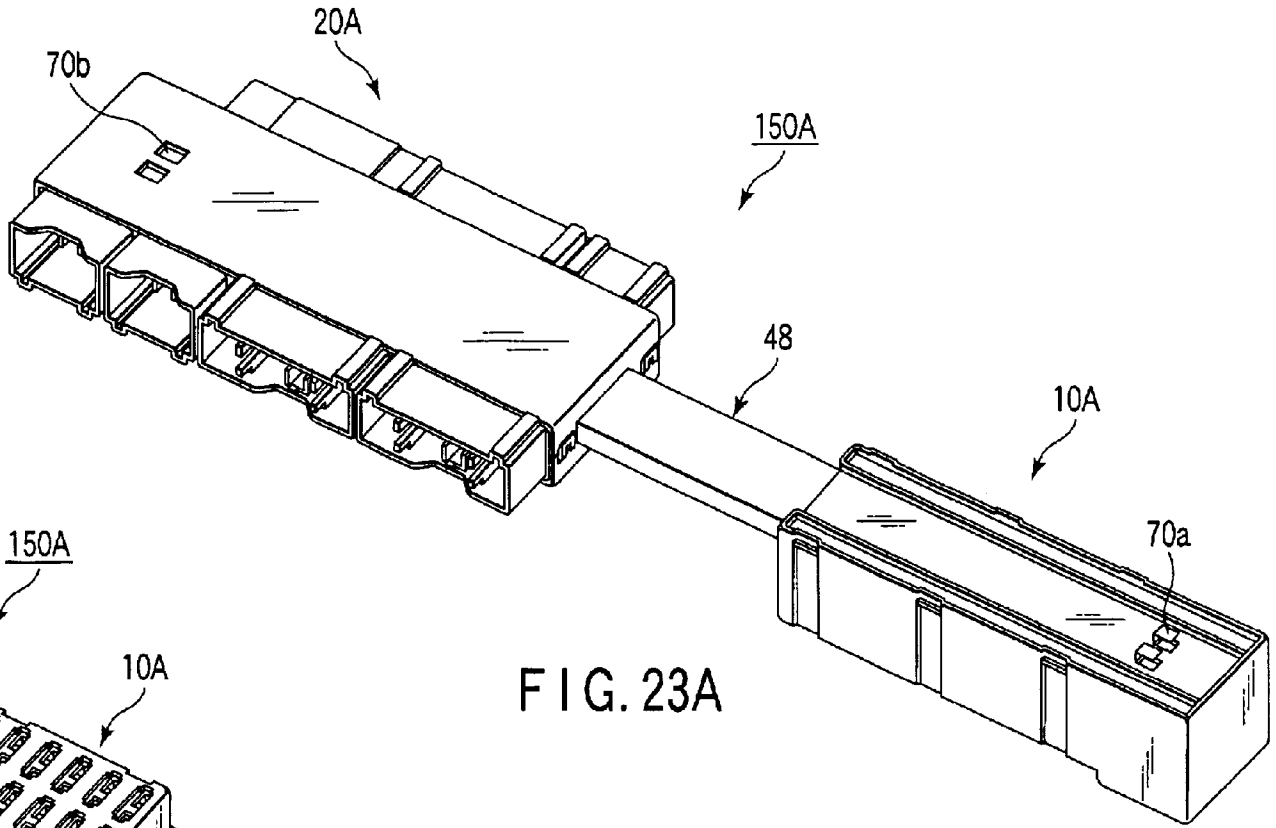
FIGS. 23A and 23B are perspective views showing the appearance of the junction box according to another embodiment of the present invention.
Figure 23B:
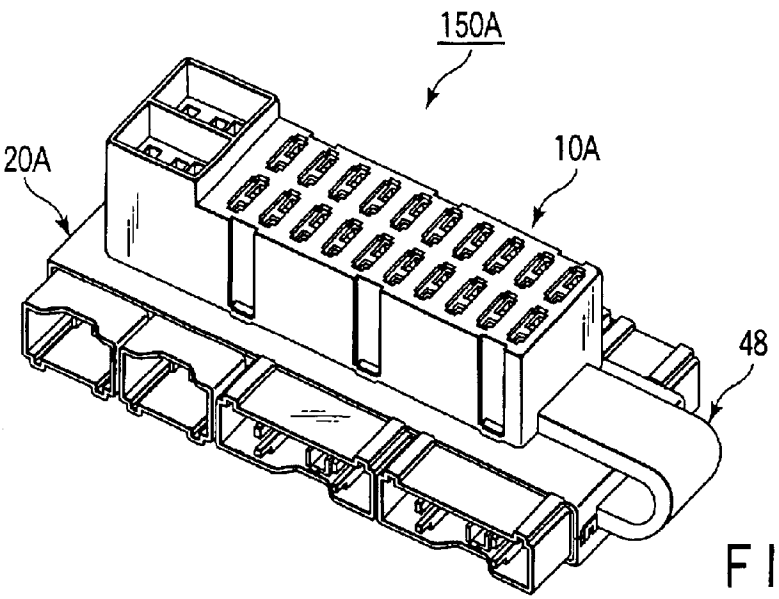

As shown in FIG. 22, a junction box 150' of this example is different from the junction box 1' of the above-described embodiment in that the cable portion 30' branched into two in the superimposition direction of the FPCs 30*a* to 30*d* is covered with the grommet 48. Moreover, as shown in FIGS. 23A and 23B, a junction box 150A of this example is different from the junction box 1A of the above-described embodiment in that the cable portion 30A (not shown) is covered with the grommet 48. When the grommet 48 is disposed in this manner, moisture, dust, and the like can effectively be prevented from entering the junction box main body 10 (10', 10A) and connector portion 20 (20*a*, 20*b*, 20A), and the cable portion 30 (30', 30A) can effectively be protected from damages caused by impact.

Figure 24A:
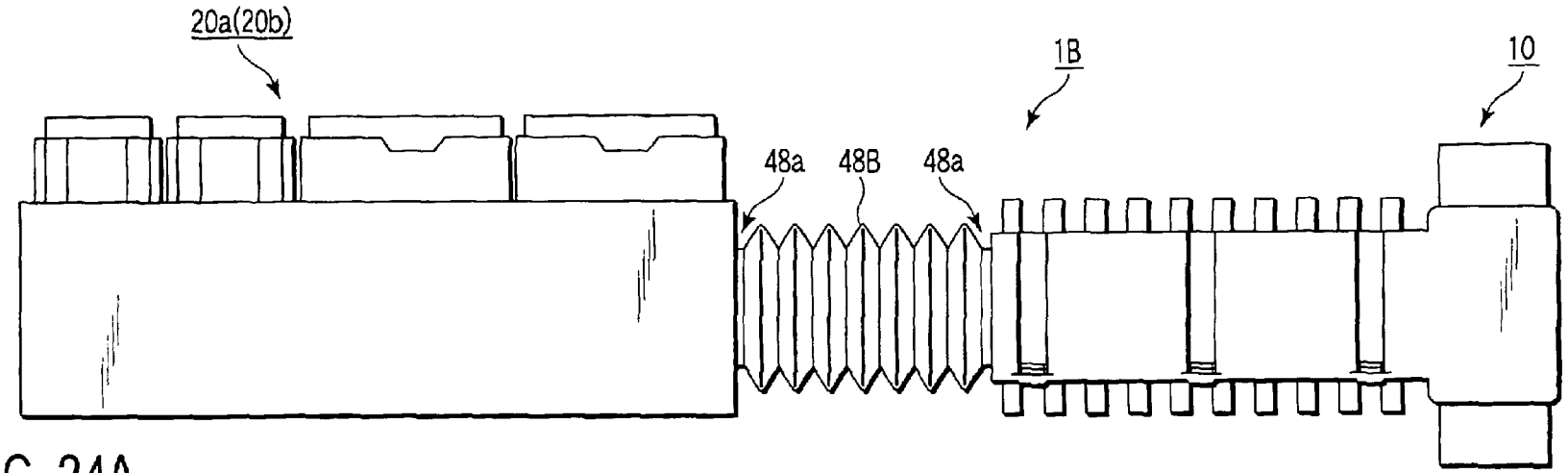
FIGS. 24A and 24B are a side view and partially sectional view showing the junction box according to another embodiment of the present invention.
Figure 24B:
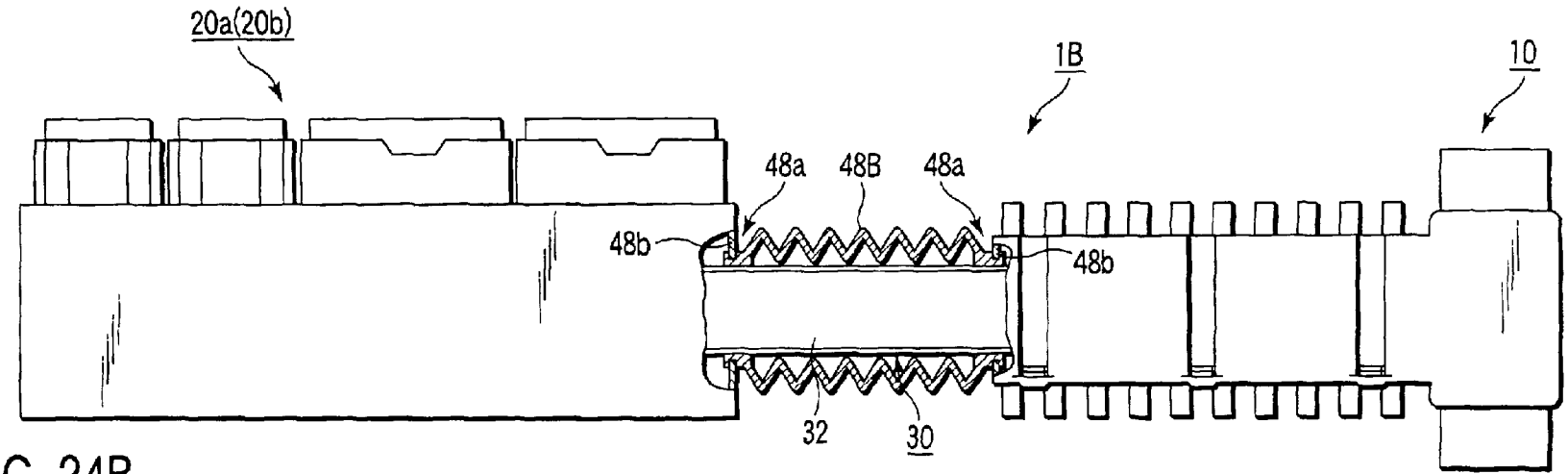

FIGS. 24A and 24B show a side view and partially sectional view showing the junction box according to still another embodiment of the present invention.

As shown in FIG. 24A, a junction box 1B includes a structure in which the junction box main body 10 is connected to the connector portion 20*a* (20*b*) via the cable portion 30 (not shown), and the exposed portion of the cable portion 30 from the junction box main body 10 and connector portion 20*a* (20*b*) is covered with a grommet 48B. As shown in FIG. 24B, the grommet 48B is formed of the above-described materials such as silicon rubber and ethylene propylene rubber (EPDM), has high flexibility and durability, and therefore constitutes a so-called bellows shape. Opposite ends 48*a* of the grommet 48 have engagement structures engaged with opening peripheral edges 48*b* of insertion ports of the cable portion 30 into the junction box main body 10 and connector portion 20*a* (20*b*), and are attached/fixed to the junction box main body 10 and connector portion 20*a* (20*b*). The grommet 48B attached in this manner can effectively prevent the moisture and dust from entering the junction box main body 10 and connector portion 20*a* (20*b*) as described above, and can effectively protect the circuit portions 32 of the respective FPCs 30*a* to 30*d* constituting the cable portion 30 in the exposed state between the main body and portion from damage and breakage. Therefore, the durability of the junction box 1B can be enhanced.

Figure 25A:
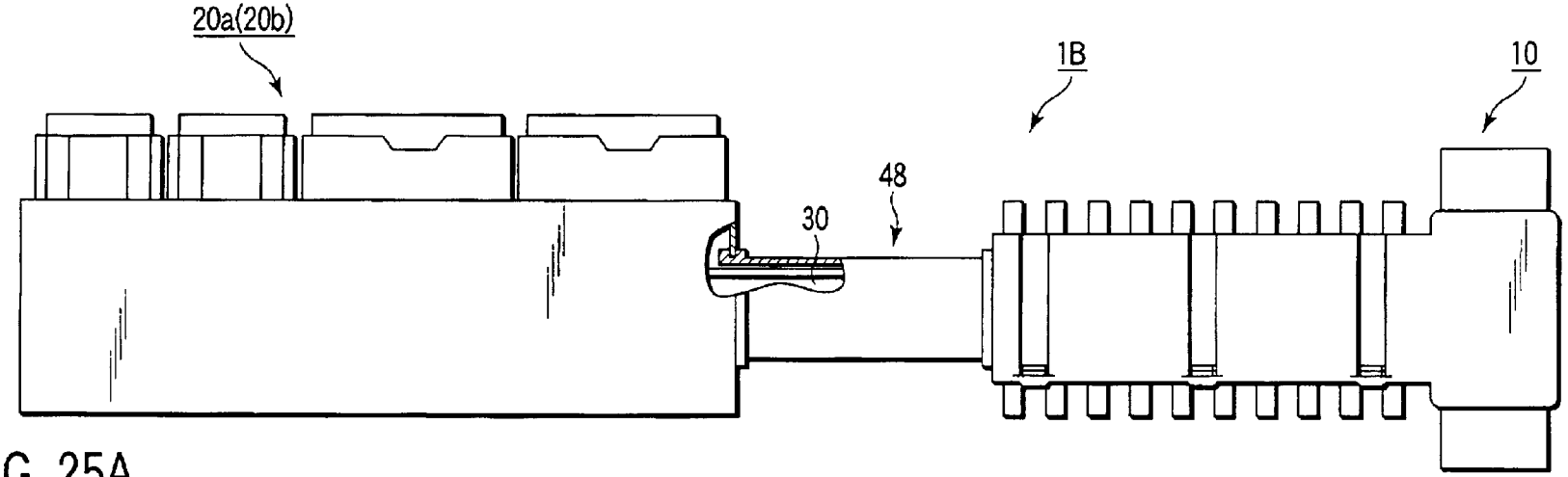
FIGS. 25A and 25B are a side view and partially sectional view showing another pattern of the junction box.
Figure 25B:
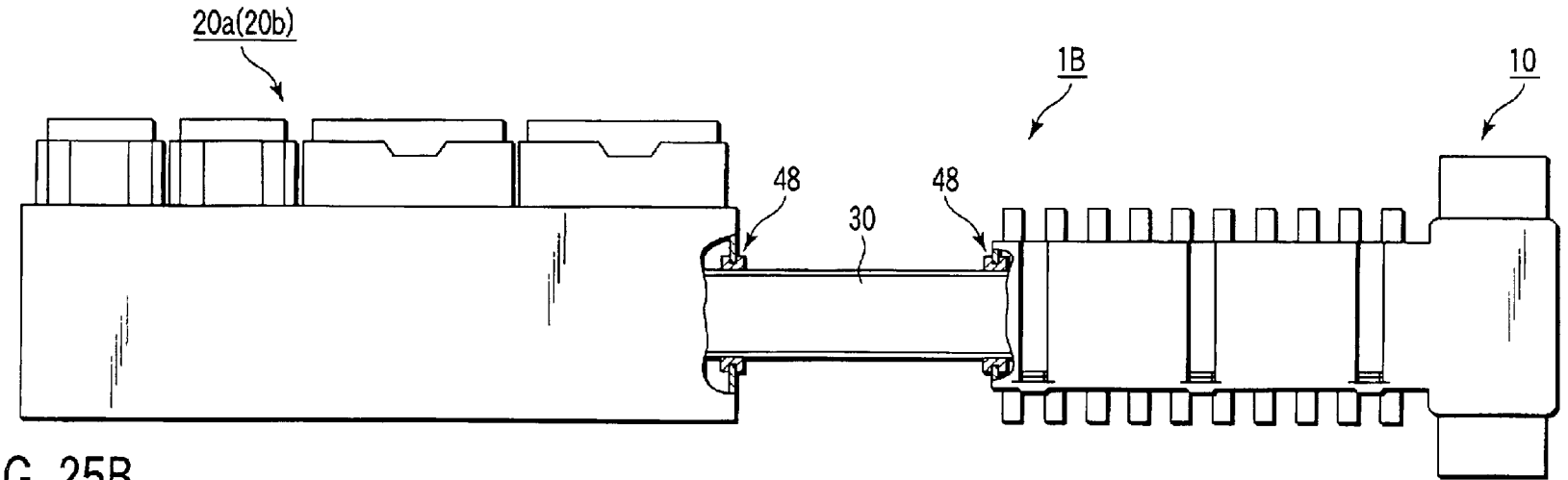

Additionally, for the grommet 48B, instead of the bellows shape, for example, a tubular shape including the above-described square section (rectangular section), or a cylindrical shape including a circular shape may be used as shown in FIG. 25A. Moreover, when it is unnecessary to cover or protect the exposed portion of the cable portion 30, as shown in FIG. 25B, the grommet 48 engaged with the opening peripheral edges 48*b* of the insertion ports of the junction box main body 10 and connector portion 20*a* (20*b*) and constituted as a packing for effectively closing the insertion ports and preventing the entrance of the moisture may be used to constitute the junction box 1B. Additionally, the grommet 48B described in this example can be applied to any one of the above-described embodiments. Needless to say, the circuit portions 32 of the respective FPCs 30*a* to 30*d* constituting the cable portion 30 (30') of the junction box 150 (150', 150B) can effectively be protected from the damage and breakage caused by the impact.

Figure 26A:
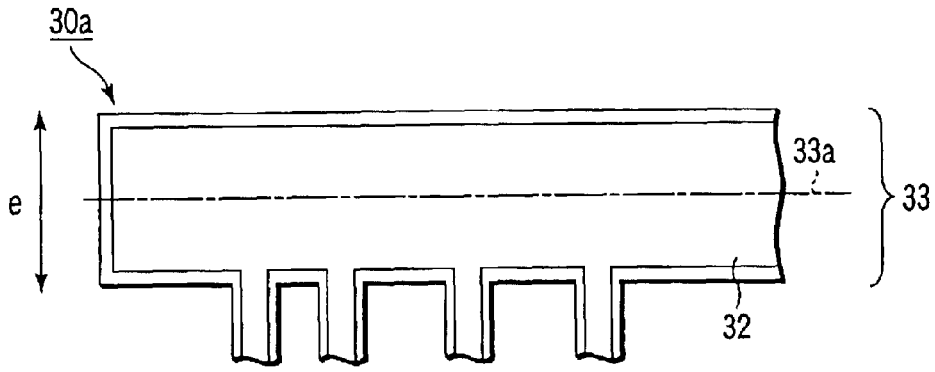
FIGS. 26A to 26C are explanatory views of another structure of the cable portion.
Figure 26B:
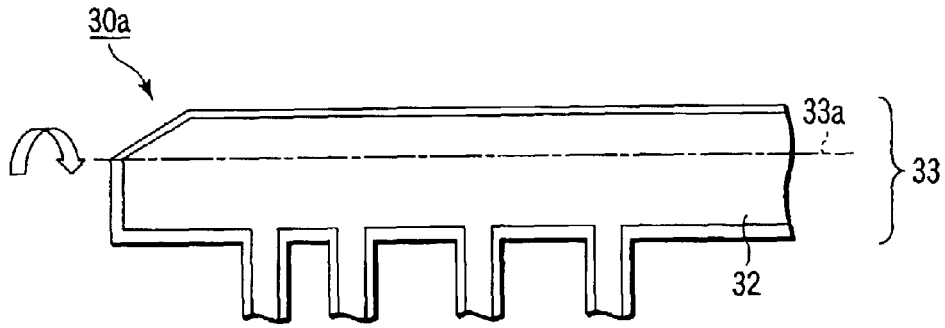
Figure 26C:
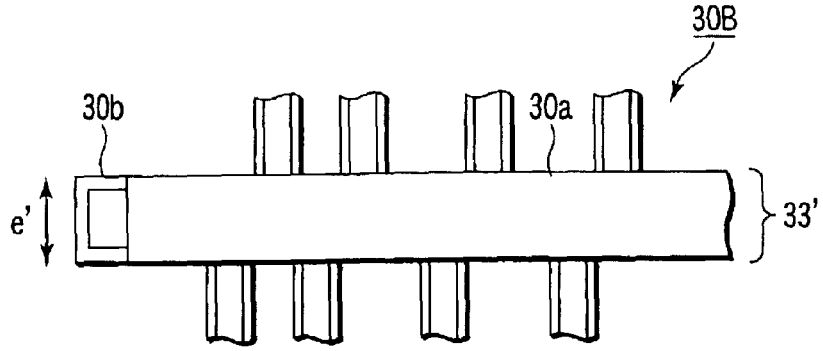

Additionally, as the above-described cable portion 30, as shown in FIGS. 26A to 26C, a cable portion 30B may also be used including a structure in which the strip portions 33 are folded back and superimposed in order to shorten a circuit width e of the circuit portion 32. In this case, for example, as shown in FIG. 26A, a center line 33*a* is determined which connects the vicinity of the center of the short direction of the strip portion 33 of the FPC 30*a* constituting the cable portion 30B in the longitudinal direction. As shown in FIG. 26B, the strip portion 33 of the FPC 30*a* is bent and superimposed along the center line 33*a* so that the surfaces with the circuit portions 32 formed thereon are disposed opposite to each other. As shown in FIG. 26C, the FPC 30*a* is superimposed onto the FPC 30*b* with a strip portion 33' formed beforehand thereon with a circuit width which meets a circuit width e' of the folded FPC 30*a*, and the cable portion 30B is formed. When the entire circuit width of the cable portion 30B is reduced in this manner, the entire height and width of the junction box 1 can be suppressed, and the junction box 1 can efficiently be miniaturized. Moreover, the FPC 30*a* having the folded strip portion 33 is set beforehand, for example, in a power supply circuit (power distribution circuit). As a result, a circuit area can be enlarged as compared with another FPC circuit. Therefore, the FPC which has high radiating properties and whose circuit width can be adapted to the circuit width of another FPC or shortened can be used as the power distribution circuit.

Figure 27A:
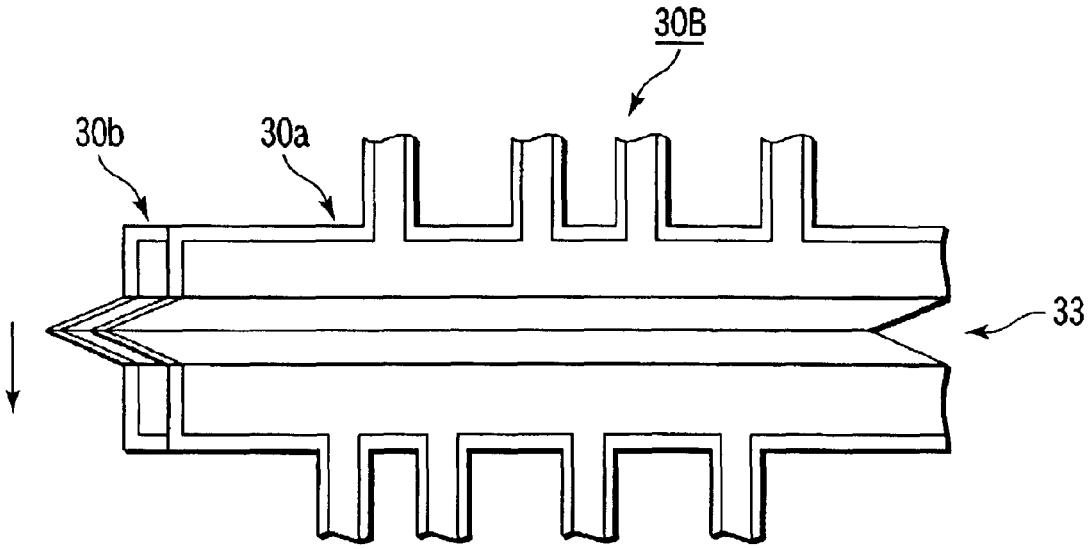
FIGS. 27A to 27B are explanatory views of another structure of the cable portion.
Figure 27B:
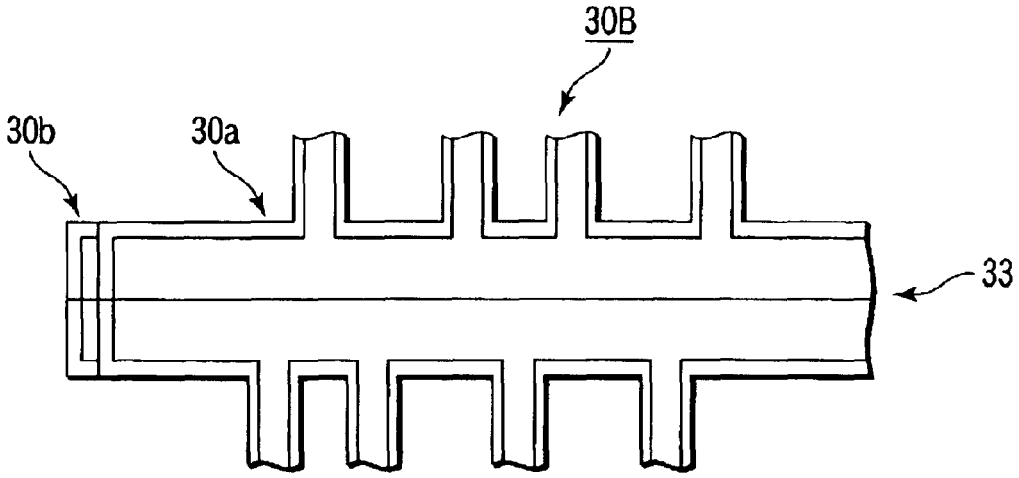

Moreover, as shown in FIG. 27A, the FPCs 30*a*, 30*b* constituting the cable portion 30B are first superimposed upon each other. Thereafter, the strip portions 33 of the respective FPCs 30*a*, 30*b* are folded so that the center line 33*a* of each strip portion 33 is positioned in the vertical direction with respect to the circuit formed surface of the circuit portion 32 (so that the center line is a bottom side of a portion folded in a trough shape or an apex of a portion folded in a mountain shape). As shown in FIG. 27B, a part of the folded strip portion 33 is further folded, and the cable portion 30B having a short circuit width may also be realized.

Additionally, the junction box 1 of the present invention is used in a mode in which the junction box main body 10 is connected to a plurality of connector portions 20 in independent states via the cable portion 30. In this case, for example, an application method shown, for example, in FIGS. 28A and 28B can be realized. That is, FIGS. 28A and 28B show diagrams of a state in which the junction box 1 is disposed in an instrument panel of a car, FIG. 28A shows the instrument panel for use in a so-called right-side steering wheel mounted car, and FIG. 28B shows the instrument panel for use in a so-called left-side steering wheel mounted car.

Figure 28A:
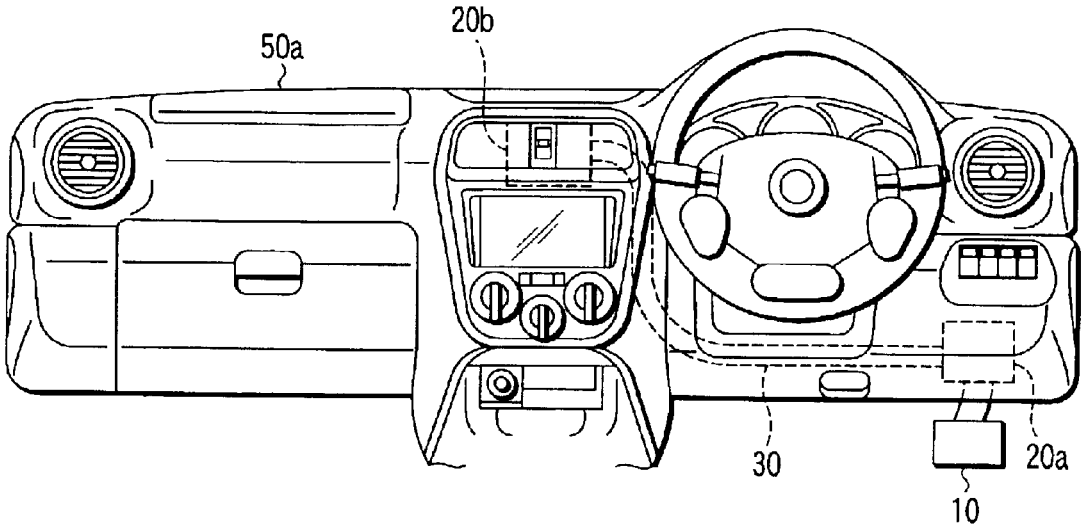
FIGS. 28A and 28B are diagrams showing that the junction box according to one embodiment of the present invention is disposed in an instrument panel of a car.
Figure 28B:
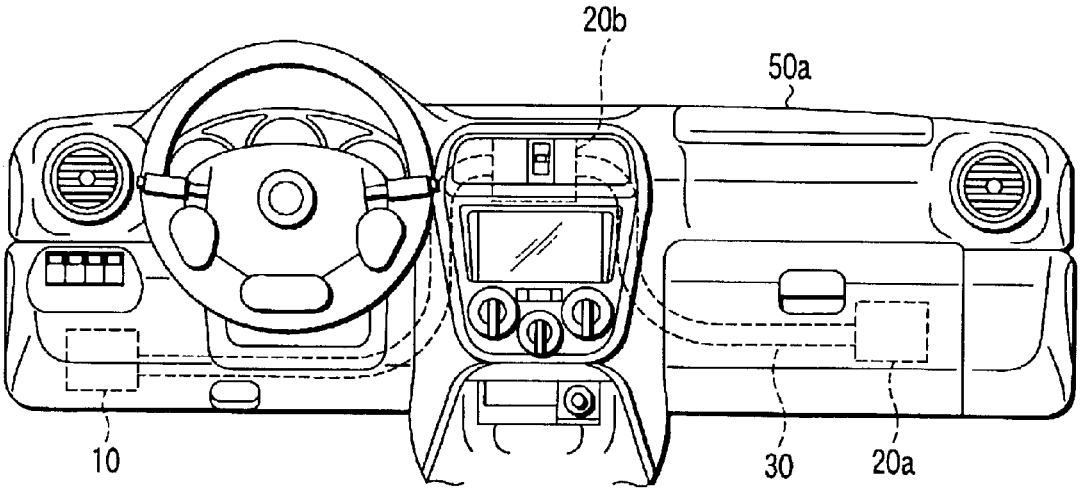

For example, with an instrument panel 50*a* of the right-side steering wheel mounted car shown in FIG. 28A, and an instrument panel 50*b* of a left-side steering wheel mounted car shown in FIG. 28B, the arrangement position of the junction box main body 10 is set in the vicinity of a steering wheel. The first connector portion 20*a* is disposed on the right as facing the instrument panel 50*a* or 50*b* and the second connector portion 20*b* is disposed in the middle of the instrument panel 50*a* or 50*b*. Then, the arrangement position of the connector portion 20*a* (20*b*) can be set in common to the right and left side steering wheel mounted cars. Therefore, a common harness can be used, the number of components can be decreased, and the cost can be reduced. As described above, according to the arrangement structure using the junction box 1, the attachment positions of the junction box main body 10 and connector portion 20*a* (20*b*) can easily be changed, and the arrangement positions can freely be determined. Therefore, a large design change is not accompanied. Even in this case, it is possible to enhance the freedom degree of layout and broaden wiring design, and the like.

Figure 29A:
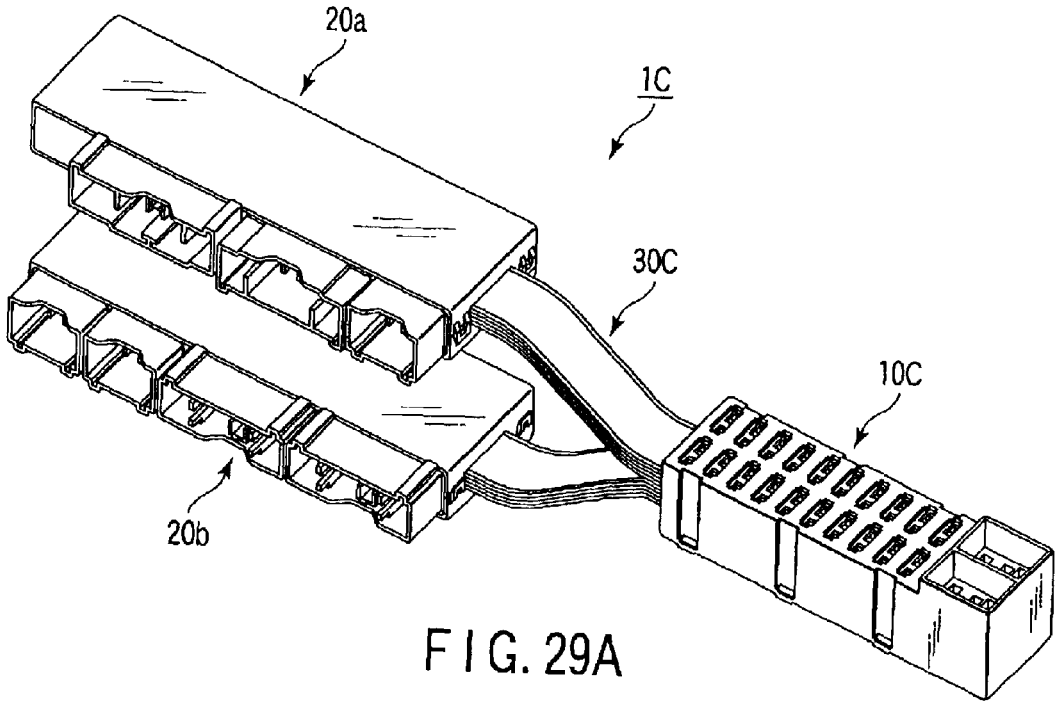
FIGS. 29A and 29B are perspective views showing the appearance of the junction box according to still another embodiment of the present invention.
Figure 29B:
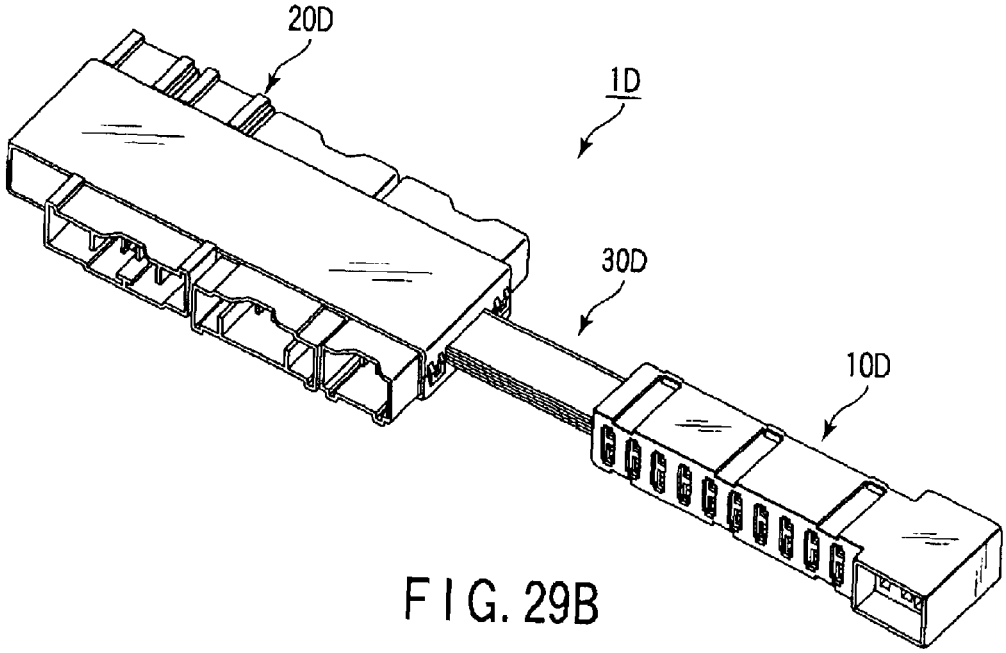
Figure 30A:
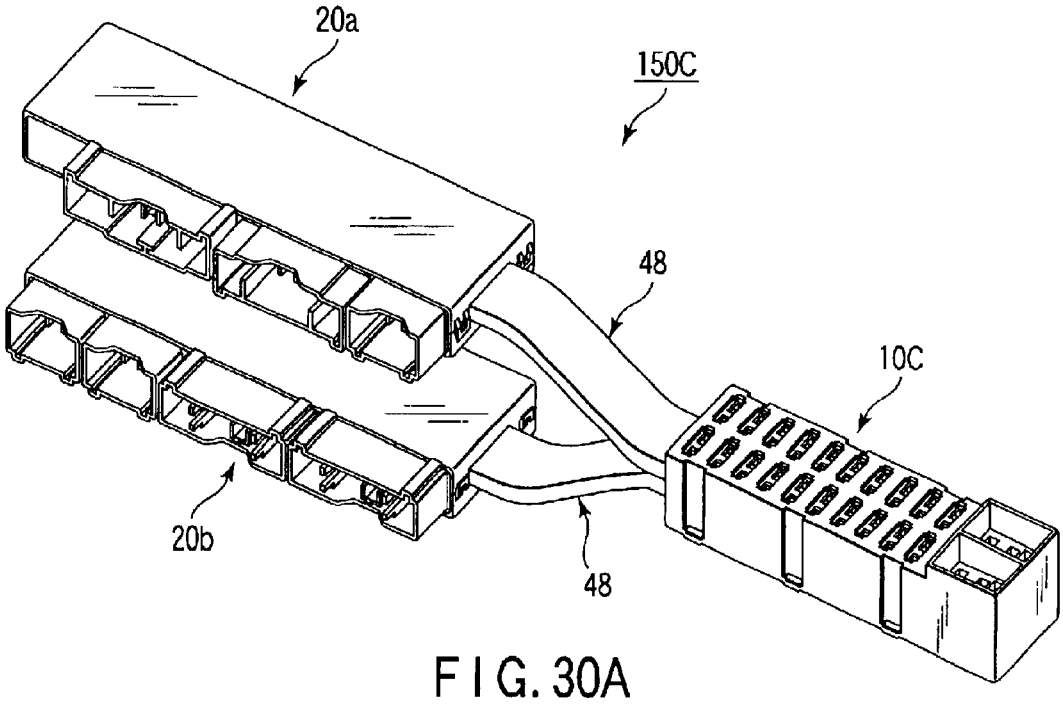
FIGS. 30A and 30B are perspective views showing the appearance of the junction box according to still another embodiment of the present invention.
Figure 30B:
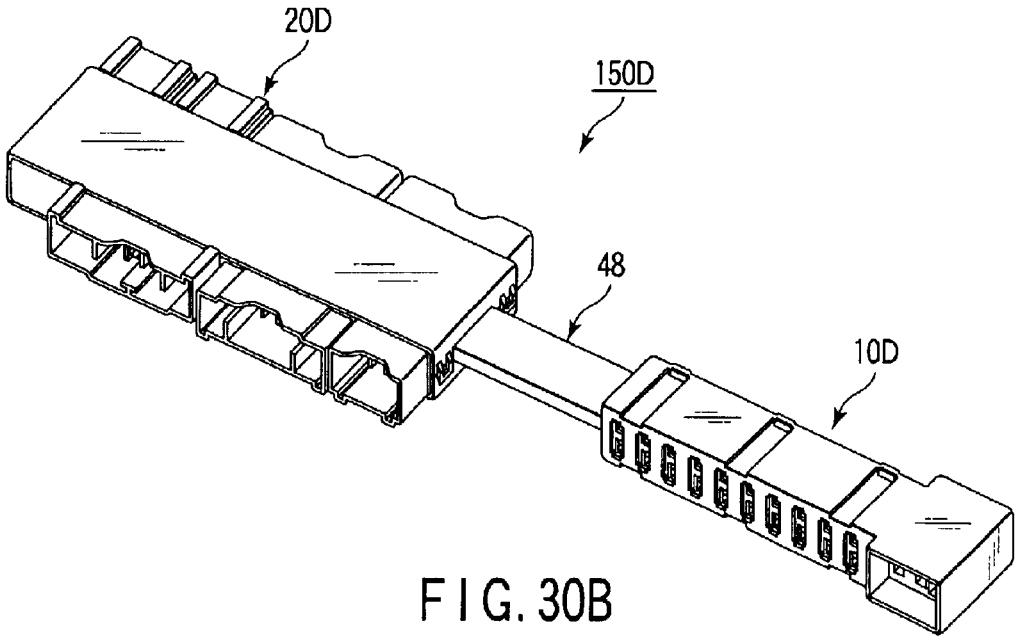
Figure 31:
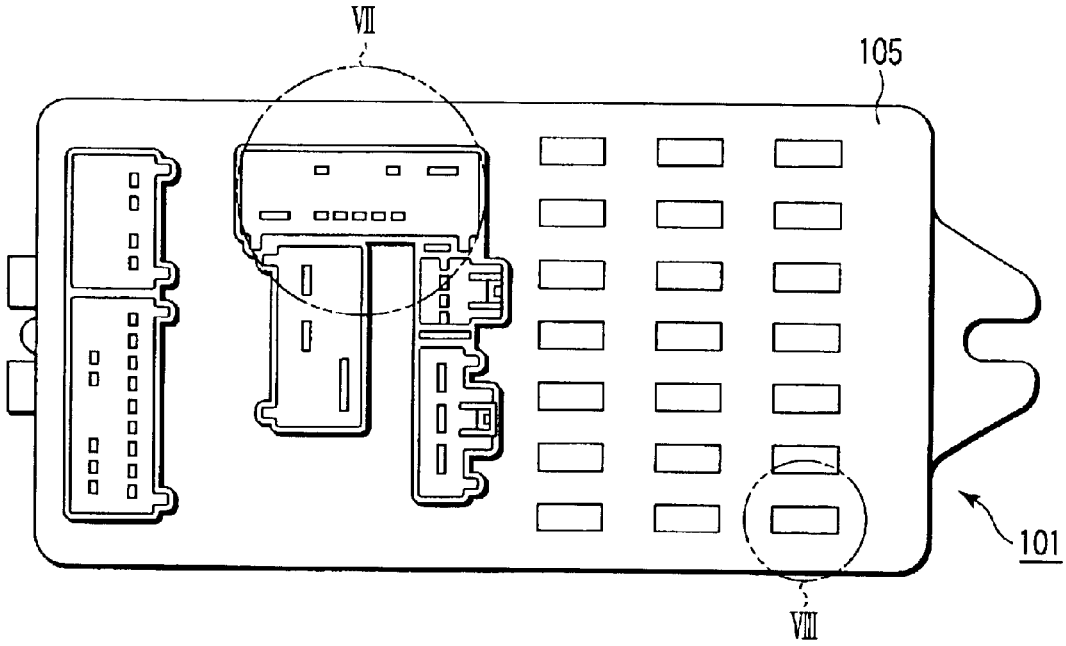
FIG. 31 PRIOR ART
FIG. 31 is a plan view of a conventional junction box.
Figure 32:
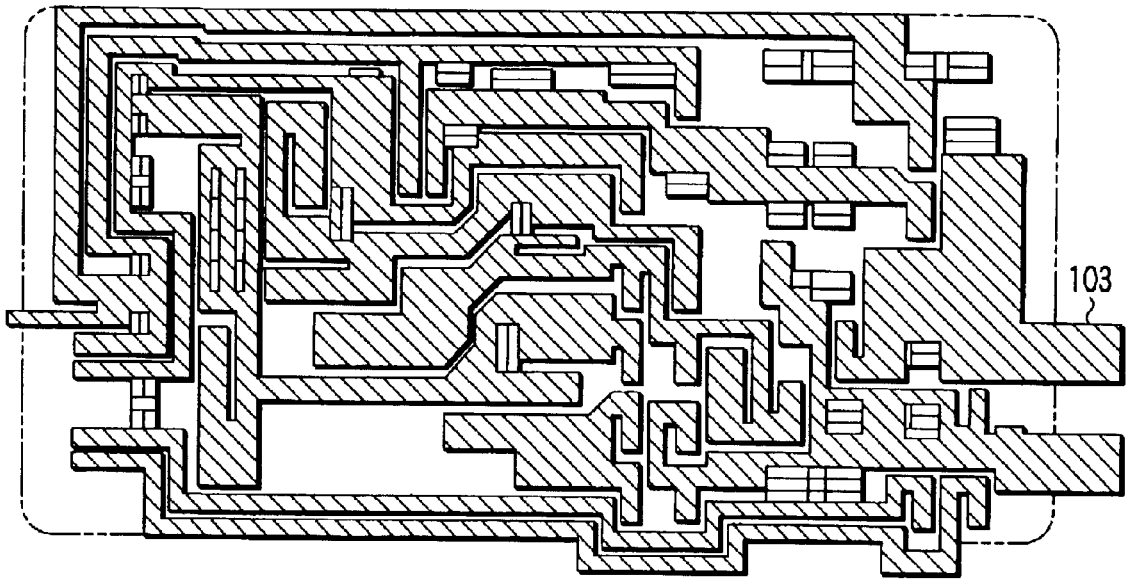
FIG. 32 PRIOR ART
FIG. 32 is a plan view of a bus bar contained in the junction box.
Figure 33:
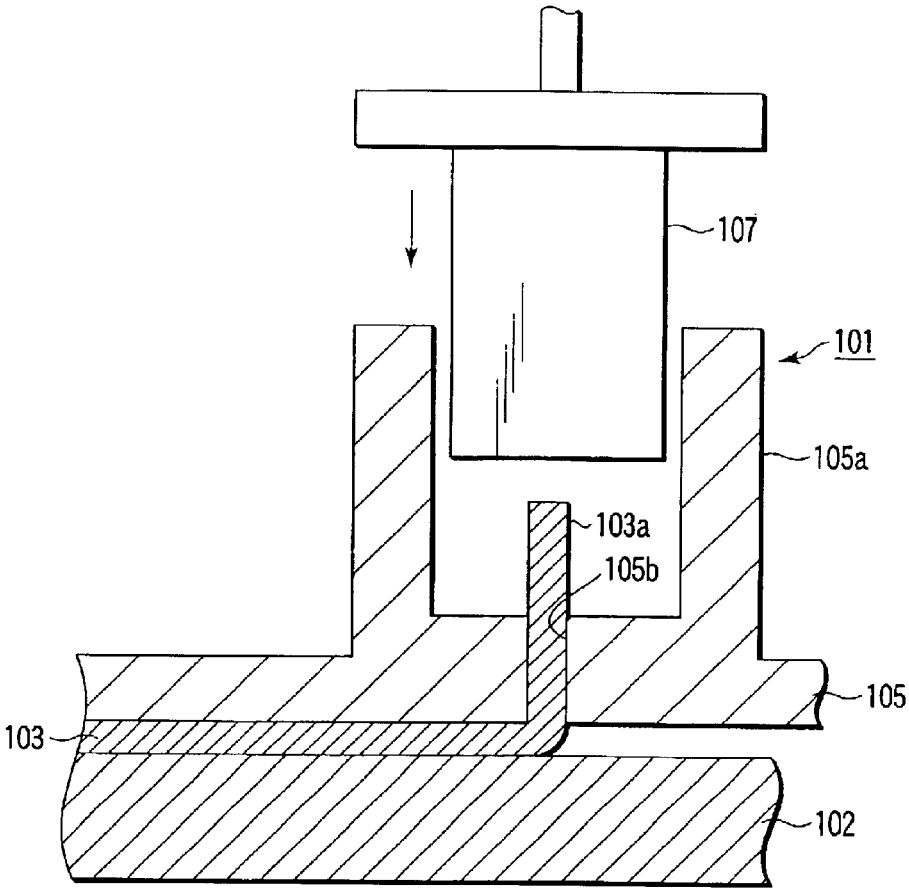
FIG. 33 PRIOR ART
FIG. 33 is a sectional view of a portion VII of FIG. 31.
Figure 35:
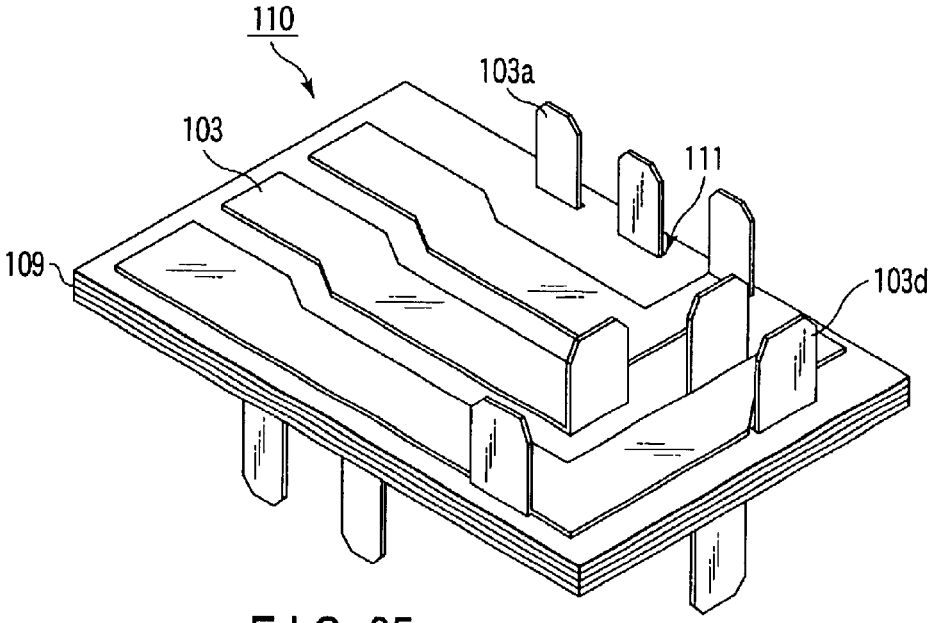
FIG. 35 PRIOR ART
FIG. 35 is an upward perspective view showing a conventional wiring circuit having a multilayered structure.
Figure 34:
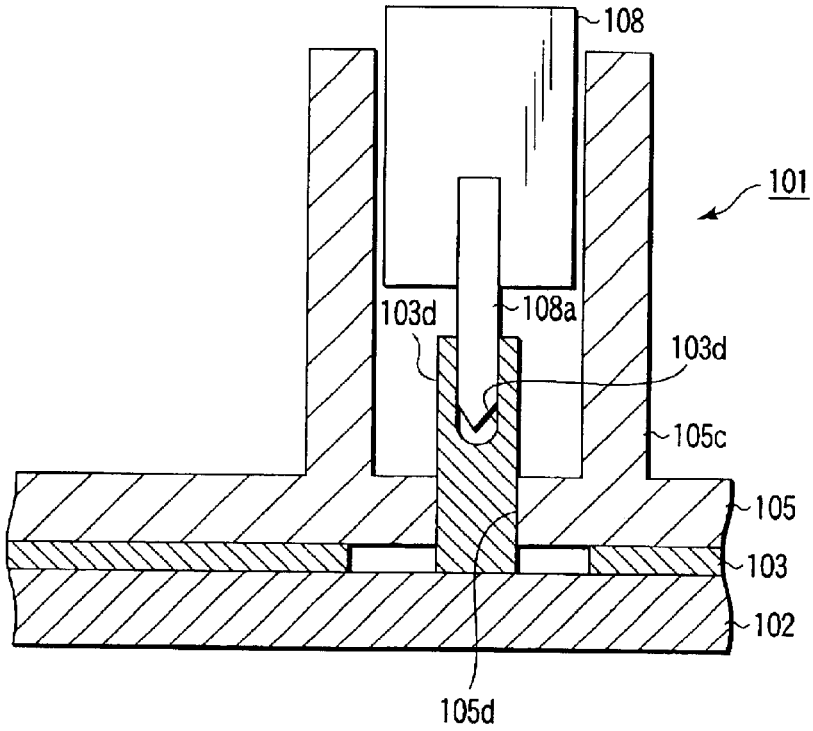
FIG. 34 PRIOR ART
FIG. 34 is a sectional view of a portion VIII of FIG. 31.
Figure 36:
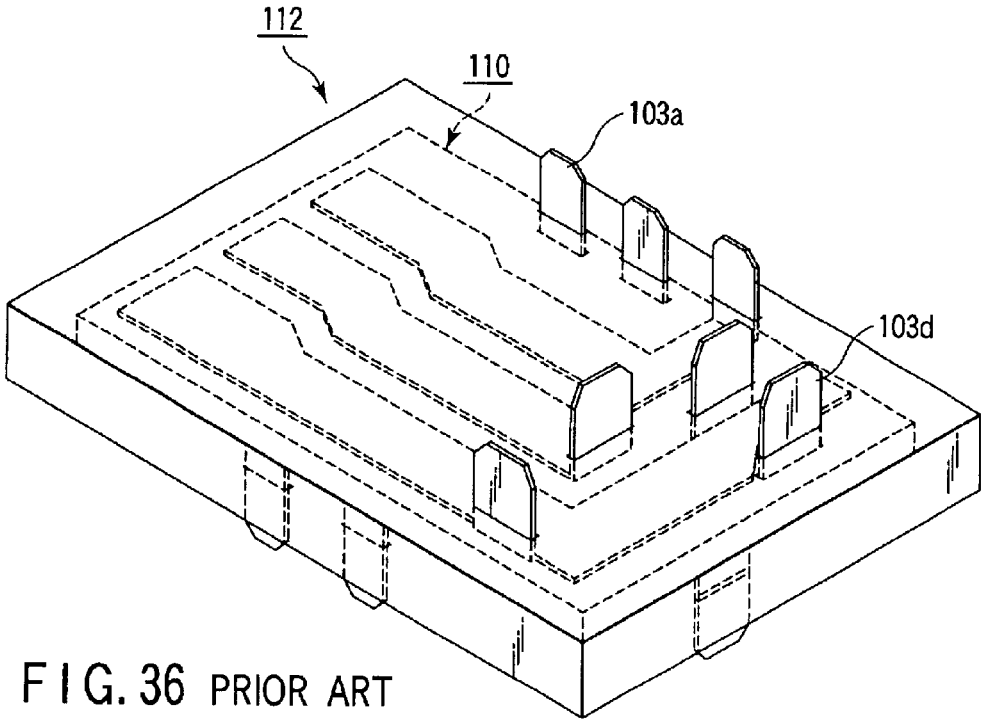
FIG. 36 PRIOR ART
FIG. 36 is an upward perspective view showing the junction box in which the conventional wiring circuit having the multilayered structure is contained.

Additionally, in the above-described embodiment, several examples of the mode of the junction box 1 have been described, but the present invention is not limited to these examples. Examples of the mode include various modes of junction boxes such as: a junction box 1C constituted of a combination of a junction box main body 10C, connector portion 20*a* (20*b*) and cable portion 30C as shown in FIG. 29A; a junction box 1D constituted of a combination of a junction box main body 10D, connector portion 20D and cable portion 30D as shown in FIG. 29B; and junction boxes 150C and 150D including structures in which the cable portions 30C, 30D of the junction boxes 1C, 1D are covered with the grommets 48 as shown in FIGS. 30A and 30B.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general invention concept as defined by the appended claims and their equivalents.

What is claimed is:

1. A junction box comprising:

a junction box main body to which an electric component to be connected is attached;

a connector portion which connects a connector of an outer wiring circuit and is formed separately from said junction box main body; and a cable portion which is constituted of a flexible printed circuit formed of a lamination of a plurality of layers, said flexible printed circuit having a circuit portion including a conductor pattern formed on an insulating film, and electrically connects said junction box main body to said connector portion, wherein said flexible printed circuit includes:

a strip portion which connects said junction box main body to said connector portion; and a terminal connecting portion extending from a side edge of a position of said strip portion in which said junction box main body and connector portion are arranged in a short direction of said strip portion, said junction box main body includes: a junction box housing including a component attachment port to which said electric component to be connected is attached; and a plate-shaped connecting terminal on a junction box main body side, which is connected to the terminal connecting portion of said flexible printed circuit and contained in said junction box housing so as to be connected to said electric component to be connected, and said connector portion includes: a connector housing which is engaged with the connector of the outer wiring circuit; and a plate-shaped connecting terminal on a connector portion side, which is connected to the terminal connecting portion of said flexible printed circuit by bending of said flexible printed circuit and contained in said connector housing so as to be connected to the connector of said outer wiring circuit.

2. The junction box according to claim 1, wherein each of the connecting terminals on said junction box main body and connector portion sides includes a plate-shaped terminal portion to be connected to any one of said electric component which is connected and the connector of said outer wiring circuit; and a plate-shaped connecting end which extends in a direction opposite to said terminal portion on a base end of the terminal portion, is formed in a thickness of a half or less of a thickness of said terminal portion, and is connected to said terminal connecting portion.

3. The junction box according to claim 1, wherein said junction box main body and said connector portion include a fixing mechanism which integrally connects both the junction box main body and the connector portion.

4. The junction box according to claim 1, wherein said plurality of flexible printed circuit layers of said cable portion are superimposed upon one another in a nonbonded state so that said terminal connecting portions of the respective flexible printed circuit layers are arranged in positions with the connecting terminal on the junction box main body side in said junction box main body and the connecting terminal on the connector portion side in said connector portion arranged therein.

5. A junction box comprising:

a junction box main body to which an electric component to be connected is attached;

a connector portion which connects a connector of an outer wiring circuit and is formed separately from said junction box main body; and a cable portion which is constituted of a flexible printed circuit with a circuit portion including a conductor pattern formed on an insulating film, and electrically connects said junction box main body to said connector portion, wherein said flexible printed circuit includes:

a strip portion which connects said junction box main body to said connector portion; and a terminal connecting portion extending from a side edge of a position of said strip portion in which said junction box main body and connector portion are arranged in a short direction of said strip portion, said junction box main body includes: a junction box housing including a component attachment port to which said electric component to be connected is attached; and a plate-shaped connecting terminal on a junction box main body side, which is connected to the terminal connecting portion of said flexible printed circuit and contained in said junction box housing so as to be connected to said electric component to be connected, and said connector portion includes: a connector housing which is engaged with the connector of the outer wiring circuit; and a plate-shaped connecting terminal on a connector portion side, which is connected to the terminal connecting portion of said flexible printed circuit and contained in said connector housing so as to be connected to the connector of said outer wiring circuit; and wherein said connector housing includes a lance mechanism which is formed to lock/fix the connecting terminal on said connector portion side inside the connector housing.

6. A junction box comprising:

a junction box main body to which an electric component to be connected is attached;

a connector portion which connects a connector of an outer wiring circuit and is formed separately from said junction box main body; and a cable portion which is constituted of a flexible printed circuit with a circuit portion including a conductor pattern formed on an insulating film, and electrically connects said junction box main body to said connector portion, wherein said flexible printed circuit includes:

a strip portion which connects said junction box main body to said connector portion; and a terminal connecting portion extending from a side edge of a position of said strip portion in which said junction box main body and connector portion are arranged in a short direction of said strip portion, said junction box main body includes: a junction box housing including a component attachment port to which said electric component to be connected is attached; and a plate-shaped connecting terminal on a junction box main body side, which is connected to the terminal connecting portion of said flexible printed circuit and contained in said junction box housing so as to be connected to said electric component to be connected, and said connector portion includes: a connector housing which is engaged with the connector of the outer wiring circuit; and a plate-shaped connecting terminal on a connector portion side, which is connected to the terminal connecting portion of said flexible printed circuit and contained in said connector housing so as to be connected to the connector of said outer wiring circuit; and wherein said connector portion is attached to said connector housing in an attachable/detachable manner, and said connector portion further includes a case portion in which at least a part of said flexible printed circuit is contained.

7. The junction box according to claim 1, wherein a grommet which is engaged with openings of insertion ports is attached to insertion ports of said flexible printed circuit layers in said junction box main body and said connector portion.

8. A junction box comprising:

a junction box main body to which an electric component to be connected is attached;

a connector portion which connects a connector of an outer wiring circuit and is formed separately from said junction box main body; and a cable portion which is constituted of a flexible printed circuit with a circuit portion including a conductor pattern formed on an insulating film, and electrically connects said junction box main body to said connector portion, wherein said flexible printed circuit includes:

a strip portion which connects said junction box main body to said connector portion; and a terminal connecting portion extending from a side edge of a position of said strip portion in which said junction box main body and connector portion are arranged in a short direction of said strip portion, said junction box main body includes: a junction box housing including a component attachment port to which said electric component to be connected is attached; and a plate-shaped connecting terminal on a junction box main body side, which is connected to the terminal connecting portion of said flexible printed circuit and contained in said junction box housing so as to be connected to said electric component to be connected, and said connector portion includes: a connector housing which is engaged with the connector of the outer wiring circuit; and a plate-shaped connecting terminal on a connector portion side, which is connected to the terminal connecting portion of said flexible printed circuit and contained in said connector housing so as to be connected to the connector of said outer wiring circuit; and wherein exposed portions of said flexible printed circuit from said junction box main body and said connector portion are entirely covered with a grommet whose opposite ends are fixed to said junction box main body and said connector portion.

9. The junction box according to claim 7 or 8, wherein said grommet has a bellows shape.

10. The junction box according to claim 7 or 8, wherein said grommet is formed of silicon rubber or ethylene propylene rubber.

11. The junction box according to claim 1, wherein the connector portion of said connecting terminal to said terminal connecting portion is sealed by a resin mold.

12. The junction box according to claim 1, wherein said electric component to be connected is at least one of a fuse and a relay.

13. The junction box according to claim 1, wherein the connecting terminal on said junction box main body side is a fork terminal whose tip end is branched into two and which holds said electric component to be connected between opposite surfaces of the branched tip end.

14. The junction box according to claim 1, wherein said connecting terminal is connected to said terminal connecting portion by resistance welding, ultrasonic welding, laser welding or soldering.

15. The junction box according to claim 1, wherein a plurality of terminal connecting portions of said flexible printed circuit are formed to extend from opposite side edges of said strip portion.

16. The junction box according to claim 1, wherein said flexible printed circuit is constituted by folding the terminal connecting portions formed on opposite side edges of said strip portion so that tip ends of the terminal connecting portions are directed in at least one of directions crossing at right angles to the main surface of said flexible printed circuit.

17. The junction box according to claim 1, wherein said junction box housing includes a lance mechanism which is formed to lock/fix the connecting terminal on said junction box main body side inside the junction box housing.

18. The junction box according to claim 1, wherein said junction box main body is disposed in the vicinity of a right or left steering wheel of an instrument panel housing of a car, said connector portion is disposed in a predetermined position of said instrument panel housing and the position of said connector portion is set in common to a right steering wheel mounted car and a left steering wheel mounted car.

19. A connector comprising:

a cable portion which is constituted of a flexible printed circuit formed of a lamination of a plurality of layers, said flexible printed circuit having a circuit portion including a conductor pattern formed on an insulating film; and a connector portion which connects the cable portion to an outer connector of an outer wiring circuit, wherein said flexible printed circuit includes: a strip portion which is partially contained in said connector portion; and a terminal connecting portion extending from a side edge of a position of the strip portion in which said connector portion is disposed in a short direction of said strip portion, and said connector portion includes a connector housing which is engaged with said outer connector; and a plate-shaped connecting terminal on a connector portion side, which is connected to the terminal connecting portion of said flexible printed circuit by bending of said flexible printed circuit and contained in said connector housing so as to be connected to said outer connector.

20. The connector according to claim 19, wherein a connected portion of the connecting terminal on said connector portion side to said terminal connecting portion is sealed by a resin mold.

21. The connector according to claim 19, wherein a plurality of said terminal connecting portions of said cable portion are arranged along a side edge of said strip portion, and connected portions of the terminal connecting portions and the connecting terminals on said connector portion side are sealed by a common resin mold so that the connected portions are arranged in one row.

22. The connector according to claim 19, wherein a plurality of said flexible printed circuit layers of said cable portion are superimposed upon one another in a non-bonded state so that said terminal connecting portions of the respective flexible printed circuit layers are arranged in positions with the connecting terminals on said connector portion side in said connector portion arranged therein.

23. The connector according to claim 19, wherein the connecting terminal on said connector portion side includes: a plate-shaped terminal portion on a tip end, which is engaged with a terminal to be connected contained in said outer connector; and a plate-shaped connecting end which is formed to extend in a direction opposite to said terminal portion on a base end of the terminal portion and connected to said terminal connecting portion.

24. The connector according to claim 19, wherein the connecting terminal on said connector portion side is connected to said terminal connecting portion by resistance welding, ultrasonic welding, laser welding or soldering.

25. The connector according to claim 19, wherein a plurality of terminal connecting portions of said flexible print circuit are formed to extend from opposite side edges of said strip portion.

26. The connector according to claim 25, wherein said flexible print circuit is constituted by folding back at least one of the terminal connecting portions formed on opposite side edges of said strip portion to the other side.

27. A connector comprising:

a cable portion which is constituted of a flexible printed circuit with a circuit portion including a conductor pattern formed on an insulating film; and a connector portion which connects the cable portion to an outer connector of an outer wiring circuit, wherein said flexible printed circuit includes: a strip portion which is partially contained in said connector portion; and a terminal connecting portion extending from a side edge of a position of the strip portion in which said connector portion is disposed in a short direction of said strip portion, and said connector portion includes a connector housing which is engaged with said outer connector; and a plate-shaped connecting terminal on a connector portion side, which is connected to the terminal connecting portion of said flexible printed circuit and contained in said connector housing so as to be connected to said outer connector wherein said connector housing includes a lance mechanism which is formed to lock/fix the connecting terminal on said connector portion side inside the connector housing.

28. A connecting terminal which is connected to a circuit portion of a flexible printed circuit with the circuit portion including a conductor pattern formed on an insulating film, and connects said circuit portion to an electric component to be connected, the connecting terminal comprising:

a plate-shaped terminal portion which is connected to said electric component to be connected; and a plate-shaped connecting end which is formed to extend in a direction opposite to said terminal portion on a base end of the terminal portion, and connected to said circuit portion, wherein said connecting end is formed to have a thickness which is a half or less of a thickness of said terminal portion.

29. The connecting terminal according to claim 28, wherein said terminal portion is formed by punching a metal parent material having the same thickness as that of said connecting end, disposing a portion constituting said connecting end as such, and folding and superimposing a portion constituting said terminal portion in a predetermined position so that the thickness of the terminal portion is two or more times the thickness of said connecting end.

30. The connecting terminal according to claim 28, wherein said connecting end is formed by punching a metal parent material having the same thickness as that of said terminal portion, disposing a portion constituting said terminal portion as such, and thinning and extending a portion constituting said connecting end with a press so that the thickness of the connecting end is a half or less of the thickness of said terminal portion.

31. The connecting terminal according to claim 28, wherein said connecting terminal is a fork terminal in which a tip end of said terminal portion is branched into two in a width direction and which holds said electric component to be connected between opposite surfaces of the branched tip end.

* * * * *